US005447275A

United States Patent [19]

Goka et al.

[11] Patent Number: 5,447,275

[45] Date of Patent: Sep. 5, 1995

[54] TONER PRODUCTION PROCESS

[75] Inventors: Yoko Goka, Kawasaki; Hitoshi Kanda; Satoshi Mitsumura, both of Yokohama; Kazuyuki Miyano, Tokyo, all of Japan

[73] Assignee: Canon Kabushiki Kaisha, Tokyo, Japan

[21] Appl. No.: 187,385

[22] Filed: Jan. 27, 1994

[30] Foreign Application Priority Data

Jan. 29, 1993 [JP] Japan ..... 5-013477
Jan. 29, 1993 [JP] Japan ..... 5-013479

[51] Int. Cl.[6] ..... B02C 23/30

[52] U.S. Cl. ..... 241/5; 241/19; 430/137

[58] Field of Search ..... 241/5, 19, 23, 24, 29; 209/2, 143, 146, 154; 430/137

[56] References Cited

U.S. PATENT DOCUMENTS

| | | | |
|---|---|---|---|
| 4,657,667 | 4/1987 | Etkin | 209/135 |
| 4,784,333 | 11/1988 | Hikake et al. | 241/5 |
| 4,802,977 | 2/1989 | Kanda et al. | 209/143 |
| 4,844,349 | 7/1989 | Kanda et al. | 241/19 |
| 4,989,794 | 2/1991 | Askew et al. | 241/16 |
| 5,016,823 | 5/1991 | Kato et al. | 241/5 |
| 5,111,998 | 5/1992 | Kanda et al. | 241/5 |

FOREIGN PATENT DOCUMENTS

| | | | |
|---|---|---|---|
| 523653 | 1/1993 | European Pat. Off. | B02C 19/06 H |
| 2642884 | 3/1978 | Germany | O07B 11/06 |
| 54-42141 | 4/1979 | Japan | G03G 13/08 |
| 55-18656 | 2/1980 | Japan | G03G 13/08 |
| 1-254266 | 10/1989 | Japan | B02C 19/06 |
| WO91-02555 | 3/1991 | WIPO | A61M 1/14 |

OTHER PUBLICATIONS

Okuda, et al., "Application of Fluidics Principle to Fine Particle Classification", Powder Technology, publ. by Hemispher Publishing Corp., pp. 771–780 (1981).

*Primary Examiner*—Timothy V. Eley
*Attorney, Agent, or Firm*—Fitzpatrick, Cella, Harper & Scinto

[57] ABSTRACT

A gas stream classifier includes: a gas stream classifying means for classifying feed powder into at least a coarse powder fraction and a fine powder fraction by an inertia force acting on particles and a centrifugal force acting on a curved gas stream due to Coanda effect in a classifying chamber, and a feed supply pipe opening into the classifying chamber for supplying the feed powder into the classifying chamber. The efficiency of the classifier is improved by providing the feed supply pipe with a mixing zone for mixing an upper stream and a lower stream of the feed powder and an accompanying gas stream, respectively flowing through within the feed supply pipe. The classifier is particularly suitably used for producing a toner for developing electrostatic images having a sharp particle size distribution from toner particles having a weight-average particle size of at most 10 μm, especially at most 8 μm.

22 Claims, 24 Drawing Sheets

B-B' SECTION

C-C' SECTION

D-D' SECTION

G-G' SECTION

H-H' SECTION

K-K' SECTION

TONER PRODUCTION PROCESS

FIELD OF THE INVENTION AND RELATED ART

The present invention relates to a gas stream classifier and a classifying method utilizing the Coanda effect, particularly a gas stream classifier and a classifying method for effectively classifying feed powder containing at least 50% by number of particles having a weight-average particle size of at most 20 μm.

The present invention further relates to a system (a process and an apparatus (system)) for producing a toner for developing electrostatic images having a prescribed particle size through effective pulverization and classification of solid particles comprising a binder resin, particularly a system for producing a toner for developing electrostatic images containing at least 50% by number of particles having a volume-average particle size of at most 20 μm.

For powder classification, various gas stream classifiers and classifying methods have been proposed. These classifiers may include a classifier using rotating blades and a classifier having no movable parts. The latter may further include a fixed wall centrifugal classifier and an inertia force classifier.

Examples of the classifier utilizing an inertia force may include a classifier proposed by Loffler, F. and K. Maly in "Symposium on Powder Technology D-2 (1981)"; an Elbow Jet classifier, commercially available from Nittetsu Kogyo K.K.; and a classifier proposed by Okuda, S. and Yasukuni, J. in "Proc. Inter. Symposium on Powder Technology, '81, 771 (1981)".

FIG. 17 is a sectional view of a conventional classifier utilizing an inertia force. In a preferred embodiment as-shown in FIG. 17, a powdery material is ejected together with a high speed gas stream through a feed pipe 16 opening into the classifier 101, while introducing a gas stream intersecting the ejected gas stream, whereby the fed powdery material is classified into coarse powder, medium powder and fine powder by the action of a centrifugal force of a curved gas stream flowing along a Coanda block 26, followed by separation with tapered edges 17 and 18, to effect a multiple division.

The fed powdery material is instantaneously introduced into the classifier through the feed pipe 16 and classified in a classifying zone to be discharged out of the classifying zone, so that it is important that the fed powdery material is sufficiently dispersed into individual particles up to the feed pipe 16 and the inlet of the classifying zone. A side view of a tubular section **16*a* before a tapered rectangular tube 16*b* leading to the classifying zone is shown in FIG. 18 and a perspective view thereof is shown in FIG. 19. The tubular section 16*a* generally assumes a shape of a rectangular parallelepiped, and the powder flowing through the tubular section 16*a* tends to flow linearly in parallel with a tube wall. If an upper stream is represented by an arrow A and a lower stream is represented by an arrow B, the respective streams are not hindered by each other or mixed with each other but flow in parallel with tubular walls to be ejected toward the Coanda block. If a powder feed is introduced from an upper side, there is a tendency that the upper stream A predominantly contains light fine powder, the lower stream B predominantly contains heavy coarse powder, and the respective particles independently flow, thus resulting in a poor dispersibility. The opening of the feed pipe 16 into the classifying zone is disposed at a certain height from the Coanda block surface. If the opening is too narrow, it is liable to be clogged with coarse particles. If the opening is too wide, the flow velocity therethrough is lowered to result in a poor dispersibility or result in different curves of falling, and the coarse powder stream is liable to disturb the fine powder stream, thus providing a restriction in increased classification accuracy. Further, there has been observed a tendency that a remarkably lowered classification accuracy is given in classification of powder containing a large proportion of coarse particles of 20 μm or larger. These phenomena are noticeably observed particularly when the opening of the tapered tube 16*b*** is disposed at a higher position. Accordingly, the opening is generally set within the range of 3–10 mm at present in view of a balance between liability of clogging and classification accuracy. The above difficulty is increased in case where the dust concentration in the powder becomes higher. If the powder is fed into the classification zone after a sufficient dispersion of the particles, an ideal classification may be performed but, if the dust concentration is high, the dispersion of the particles is liable to be insufficient and cause a lower classification accuracy, resulting in a lower product yield in removal of fine powder fraction from a feed powder or an increase in the amount of the fine powder fraction. Accordingly, there has been a problem that the throughput of the feed material by the classifier has to be suppressed.

Further, in recent years, there has been an increasing demand for higher image quality and higher resolution images by copying machines and printers, and therefore the toner as a developer therefor is required of severer performances. Correspondingly, the toner particle size is required to be smaller and the distribution thereof is required to be sharper and free from coarse particles.

A toner for developing electrostatic images generally comprises materials, such as a binder resin for fixation onto a transfer-receiving material like paper, a colorant for providing a color to the toner, a charge control agent for imparting a charge to the toner particles, and/or a magnetic material for providing a toner constituting a monocomponent developer (as disclosed in Japanese Laid-Open Patent Application (JP-A) 54-42141 and JP-A 55-18656), and optional additives, such as a release agent, and a flowability-imparting agent. A toner may be generally produced through a process wherein such materials are dry-blended, melt-kneaded by a conventional kneading apparatus such as a roll mill or an extruder, cooled to be solidified, pulverized by a means such as a jet air stream pulverizer or a mechanical impact pulverizer, and classified by a pneumatic classifier to provide particles having a required particle size. The particles are then optionally dry-blended with a flowability-improving agent, a lubricating agent, etc. In order to provide a two-component developer, such a toner is blended with a various magnetic carrier.

In order to obtain fine toner particles in the above-described manner, a process represented by a flow chart shown in FIG. 37 has been conventionally adopted.

Referring to FIG. 37, a coarsely pulverized material is supplied continuously or successively to a first classifying means, and the classified coarse powder mainly comprising coarse particles having a particle size above the prescribed range is fed to a pulverizing means for further pulverization and recycled to the first classifying means.

The remaining fine toner pulverization product mainly comprising particles within the prescribed size range and particles blow the prescribed size range is sent to a second classifying means to be classified into medium powder mainly comprising particles within the prescribed size range and fine powder mainly comprising blow the prescribed size range.

The pulverizing means may be a various apparatus but, for pulverization of a toner comprising a binder resin, there has been generally used a jet gas stream pulverizer, particularly an impinging gas stream pulverizer as shown in FIG. 38.

In an impinging gas stream pulverizer using a high-pressure gas, such as a let gas stream, a powder feed is conveyed by a jet gas stream and ejected through an outlet 445 of an accelerating pipe to cause the powdery feed to impinge onto an impinging surface 441 of a impinging member 443 disposed opposite to the opening of the outlet 445 of the accelerating pipe, thereby pulverizing the powdery feed by the impact of the impingement.

More specifically, in an impinging gas stream pulverizer shown in FIG. 38, the impinging member 443 is disposed opposite to the outlet 445 of the accelerating pipe 446 to which a high-pressure gas supply nozzle 447 is connected, and a powdery feed is suctioned through a powder feed inlet 440 communicating with an intermediate part of the accelerating pipe 446 into the accelerating pipe 446 and-ejected together with the high-pressure gas to impinge onto the impinging surface 441 of the impinging member 443 to be pulverized by the impingement energy.

In the impinging gas stream pulverizer shown in FIG. 38, however, the pulverized material inlet 440 is disposed at an intermediate part of the accelerating pipe 446, so that the pulverized material introduced by suction into the accelerating pipe is caused at a point immediately after passing the pulverized material inlet 440 to change its flow direction toward the outlet of the accelerating pipe 446 by a high-pressure gas stream ejected from the high-pressure gas supply nozzle 447 and is rapidly accelerated while being dispersed into the high-pressure gas stream. In this state, relatively coarse particles in the pulverized material flow at a lower stream part in the accelerating pipe due to an inertia force, and relatively fine particles flow at a higher stream part, so that these two types of particles are not sufficiently uniformly dispersed but locally concentratively impinge onto the opposing impinging member 443 while being separated as the higher stream and the lower stream. As a result, the pulverization efficiency is liable to be lowered to lower the capacity of the pulverizer.

In the neighborhood of the impinging surface 441, there is liable to occur a local region containing dust composed of the pulverized material at a high concentration, so that, if the pulverized material contains a low-temperature melting substance such as a resin, the pulverized material is liable to cause melt-sticking, coarse particle formation or agglomeration. If the pulverized material has an abrasive characteristic, the impinging surface of the impinging member and the accelerating pipe are liable to be abraded thereby, so that the impinging member has to be renewed frequently. This requires an improvement for continuous and stable production.

A conically shaped impinging member having an impinging surface of which the tip has an apex angle of 110–175 degrees (JP-A1-254266) and an impinging member having a projection on its impinging surface at a part on the central axis of the impinging member (Japanese Laid-Open Utility Model Application 1-148740) have been proposed. Pulverizers having such impinging members can suppress the local increase of the dust concentration in the neighborhood of the impinging surface, so that the melt-sticking, coarse particle formation and agglomeration of the pulverized material can be alleviated to some extent and the pulverization efficiency is somewhat increased. A further improvement is however desired.

For example, in order to obtain a toner having a weight-average particle size of 8 μm and containing particles of at most 4 μm at a volume % of 1% or below, it has been practiced to pulverize and classify the feed material to a prescribed average particle size by using a pulverizing means, such as an impinging gas stream classifier having a classifying mechanism for removing a coarse powder fraction, and classify the pulverized material after removal of the coarse powder by another classifying means to remove the fine powder fraction, thereby obtaining a desired medium powder product.

Herein, the weight-average particle size is based on data measured by using a Coulter counter ("TA-II", available from Coulter Electronix Co., U.S.A.) equipped with a 100 μm aperture.

As a problem in such a conventional process, the load on the pulverization means becomes large and the capacity thereof (throughput) is suppressed because the second classifying means for removing the fine powder fraction has to be supplied with particles completely free from coarse particles exceeding a prescribed particle size. In order to completely remove such coarse particles exceeding a prescribed particle size, the pulverization is inevitably liable to be performed excessively, so that a lowering in yield is liable to be caused in the subsequent second classifying means for removing the fine powder fraction.

For the second classifying means for removing the fine powder fraction, various gas stream classifiers and classifying methods have been proposed. As described above, these classifiers may include a classifier using rotating blades and a classifier having no movable parts. The latter classifier further includes a fixed-wall centrifugal classifier, and a classifier utilizing an inertia force, the examples of which have been already discussed.

The conventional system is liable to include complicated steps and cause a lowering in classification efficiency, an insufficient production efficiency and an increased production cost, even if a desired product having an accurate particle size distribution can be obtained thereby. This tendency is further pronounced where the prescribed particle size is lowered.

U.S. Pat. No. 4,844,349 has proposed a process and an apparatus for producing a toner, using a first classifying means, a pulverizing means and a multi-division classifying means as a second classifying means. It is, however, desired to develop a system (process and apparatus) for producing a toner having a weight-average particle size of at most 8 μm in a further stable and efficient manner.

SUMMARY OF THE INVENTION

An object of the present invention is to provide an apparatus and a method for gas stream classification of a powdery material to solve the above-mentioned problems.

Another object of the present invention is to provide an apparatus and a method for gas stream classification suitable for effective production of a toner for developing electrostatic images.

Another object of the present invention is to provide an apparatus and a method for gas stream classification for effective recovery of toner particles having a sharp particle size distribution from a toner powder feed having a weight-average particle size of at most 10 μm.

A further object of the present invention is to provide an apparatus and a method for gas stream classification for effective recovery of toner particles having a sharp particle size distribution from a toner powder feed having a weight-average particle size of at most 8 μm.

Another object of the present invention is to provide a process for producing a toner for developing electrostatic images containing at least 50% by number of particles of 20 μm or smaller, having solved the above-mentioned problems involved in the conventional process.

Another object of the present invention is to provide an apparatus (system) for effective production of a toner for developing electrostatic images.

Another object of the present invention is to provide a process and an apparatus (system) for effective production of a toner for developing electrostatic images having an accurate particle size distribution.

Another object of the present invention is to provide a process and an apparatus (system) for producing a powdery product (used as a toner) having an accurate prescribed particle size distribution efficiently and at a high yield by classification of solid particles which have been formed by melt-kneading a mixture comprising a binder resin, a colorant and additives and pulverizing the kneaded product after cooling.

Another object of the present invention is to provide a process and an apparatus (system) for effective production of a toner for developing electrostatic images having a weight-average particle size of at most 10 μm, preferably at most 8 μm.

According to the present invention, there is provided a gas stream classifier, comprising:

a gas stream classifying means for classifying feed powder into at least a coarse powder fraction and a fine powder fraction by an inertia force acting on particles and a centrifugal force acting on a curved gas stream due to Coanda effect in a classifying chamber, and a feed supply pipe opening into the classifying chamber for supplying the feed powder into the classifying chamber, wherein the feed supply pipe is provided with a mixing zone for mixing an upper stream and a lower stream of the feed powder and an accompanying gas stream, respectively flowing through within the feed supply pipe.

According to another aspect of the present invention, there is provided a process for classifying feed powder, comprising:

introducing the feed powder together with a gas into a feed supply pipe to form an upper stream and a lower stream of the feed powder and an accompanying gas stream, respectively flowing through the feed supply pipe, causing the upper stream and the lower stream to change their flowing directions to mix the upper and lower streams, ejecting the feed powder at a speed of 50–300 m/sec into a classifying zone together with and under the action of the accompanying gas stream, and classifying the feed powder into at least a coarse powder fraction and a fine powder fraction under the action of an inertia force acting on particles of the feed powder ejected and a centrifugal force of a curved gas stream due to Coanda effect.

According to another aspect of the present invention, there is provided a process for producing a toner, comprising:

melt-kneading a blend comprising at least a binder resin and a colorant to form a kneaded product, cooling the kneaded product, crushing the cooled kneaded product to form a crushed product, classifying the crushed product into coarse powder and fine powder by a first classifying means, pulverizing the coarse powder by an impinging gas stream pulverizing means to form finer powder, recycling the finer powder to the first classifying means and introducing the fine powder from the first classifying means to the second classifying means, and classifying the fine powder to recover a medium powder fraction constituting a toner for developing electrostatic images, wherein said impinging gas stream pulverizing means comprises an accelerating pipe for conveying and accelerating the coarse powder supplied thereto together with a compressed gas stream, a pulverizing chamber for pulverizing the coarse powder, a coarse powder inlet for supplying the coarse powder into the accelerating pipe disposed close to a rear end of the accelerating pipe, and an impinging member having an impinging surface confronting an outlet opening of the accelerating pipe and disposed within the pulverizing chamber; said pulverizing chamber having a side wall and an entrance wall defining the outlet opening of the accelerating pipe, the side wall having a function of further pulverizing a pulverized product of the coarse powder pulverized by impingement onto the impinging member, said impinging member being disposed within the classifying chamber so that a peripheral edge of the impinging is spaced with a minimum distance $L_1$ from the side wall of the pulverizing chamber and with a minimum distance $L_2$ from the entrance wall of the pulverizing chamber satisfying $L_1 < L_2$;

said second classifying means comprises a classifying chamber and a feed supply pipe leading to and opening into the classifying chamber;

the fine powder from the first classifier is introduced as a feed powder together with a gas into the feed supply pipe to form an upper stream and a lower stream of the feed powder and an accompanying gas stream, respectively flowing through the feed supply pipe;

the upper stream and the lower stream are caused to change their flowing directions to be mixed with each other, the feed powder is ejected at a speed of 50–300 m/sec into the classifying chamber together with and under the action of the accompanying gas stream;

the feed powder is classified into at least a coarse powder fraction, a medium powder fraction and a fine powder fraction under the action of an inertia force acting on particles of the feed powder ejected and a centrifugal force of a curved gas stream due to Coanda effect;

the coarse powder fraction principally comprising particles having a particle size exceeding a prescribed range is recovered in a first fractionating zone, the medium powder fraction principally comprising particles having a particle size within the prescribed range, and the fine powder fraction principally comprising particles having a particle size below the prescribed range; and the recovered coarse powder fraction is recycled to the impinging gas stream pulverizing means or the first classifying means.

According to a further aspect of the present invention, there is provided an apparatus for producing a toner, comprising:

first classifying means for classifying a crushed product into coarse powder are fine powder, pulverizing means for pulverizing the coarse powder from the first classifying means into finer powder, introduction means for introducing the finer powder from the pulverizing means to the first classifying means, second classifying means comprising a multi-division classifying means for classifying the fine powder from the first classifying means into at least a coarse powder fraction, a medium powder fraction and a fine powder fraction due to Coanda effect, and supply means for supplying the coarse powder fraction to the pulverizing means or the first classifying means; wherein said pulverizing means comprises an accelerating pipe for conveying and accelerating the coarse powder supplied thereto together with a compressed gas stream, a pulverizing chamber for pulverizing the coarse powder, a coarse powder inlet for supplying the coarse powder into the accelerating pipe disposed close to a rear end of the accelerating pipe, and an impinging member having an impinging surface confronting an outlet opening of the accelerating pipe and disposed within the pulverizing chamber; said pulverizing chamber having a side wall and an entrance wall defining the outlet opening of the accelerating pipe, the side wall having a function of further pulverizing a pulverized product of the coarse powder pulverized by impingement onto the impinging member, said impinging member being disposed within the classifying chamber so that a peripheral edge of the impinging is spaced with a minimum distance $L_1$ from the side wall of the pulverizing chamber and with a minimum distance $L_2$ from the entrance wall of the pulverizing chamber satisfying $L_1 < L_2$; and said second classifying means comprises a classifying chamber and a feed supply pipe leading to and opening into the classifying chamber for supplying the fine powder from the first classifying means as feed powder to the classifying chamber; said feed supply pipe being provided with a mixing zone for mixing an upper stream and a lower stream of the feed powder and an accompanying gas stream, respectively flowing through the feed supply pipe.

These and other objects, features and advantages of the present invention will become more apparent upon a consideration of the following description of the preferred embodiments of the present invention taken in conjunction with the accompanying drawings, wherein like reference numerals are used to denote like parts.

DETAILED DESCRIPTION OF THE INVENTION

According to the present invention, an upper stream and a lower stream of the feed powder and an accompanying gas stream flowing through within a feed supply tube are mixed with each other and are caused to change their stream paths, whereby the dispersion of the feed powder is improved to provide a good classification accuracy even at a high concentration of dust (i.e., feed powder or processed powder), thereby preventing a lowering in product yield. According to the present invention, at an identical dust concentration, a better classification accuracy and a better product yield can be attained.

Hereinbelow, the process and apparatus according to the present invention will be described with reference to an embodiment of a three-division classification.

Figure 1:
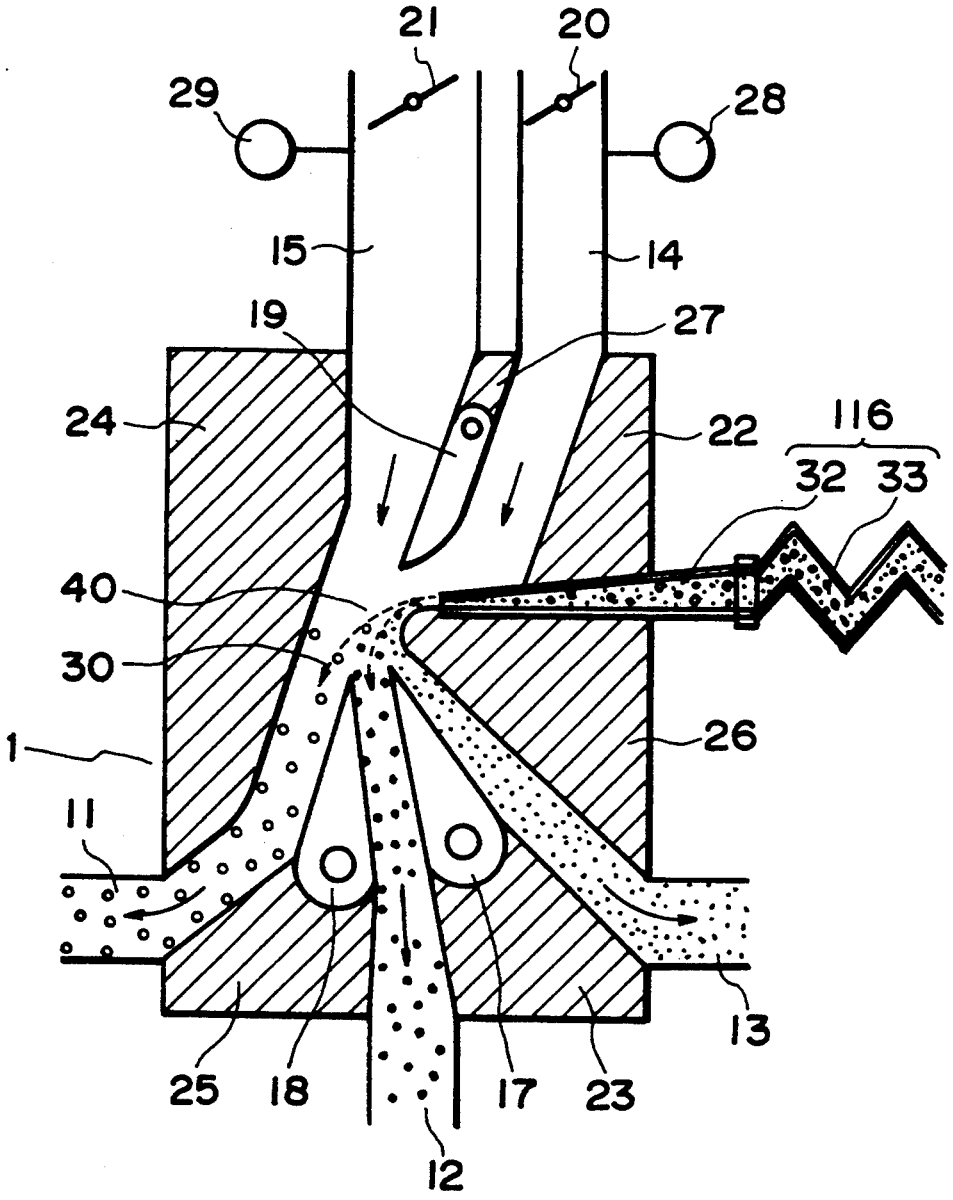
FIG. 1 is a side sectional view of an embodiment of the gas stream classifier according to the invention.

FIG. 1 is a sectional view of a gas stream classifier 1 according to the present invention. Referring to FIG. 1, the classifier 1 includes side walls 22 and 24 having shapes as shown and lower walls 23 and 25 having shapes as shown. The lower walls 23 and 25 are provided with classifying edges 17 and 18, respectively, in the form of knife edges, so as to divide the classifying zone in three sections. Below the side wall 22 is disposed a feed supply pipe 116 comprising a supply nozzle 32 opening into a classifying chamber 40 and a tube section 33 leading to the supply nozzle 32. Below the supply nozzle 32, a Coanda block 26 is disposed so as to extend along a lower tangential line of the supply nozzle 32 and be folded downwardly to form a long elliptical arcuate section. Above the classifying chamber 40, an upper wall member 27 equipped with an intake edge 19 in the form of a knife edge is disposed, and also gas intake pipes 14 and 15 are disposed so as to respectively open into the classifying chamber 40. The gas intake pipes 14 and 15 are equipped with first and second gas intake control means 20 and 21, such as dampers, and static pressure gauges 28 and 29. The classifying edges 17 and 18 and the gas intake edge 19 are respectively disposed movably, and their positions are controlled depending on the kind of the feed powder to be classified and the objective particle size. At the bottom of the classifying chamber 40 are disposed exhaust pipes 11, 12 and 13 opening into the classifying chamber so as to correspond to the respective classifying sections. The exhaust pipes 11, 12 and 13 can be respectively provided with shutter means such as valves.

The feed supply pipe 116 will now be described in further detail while referring to the drawings.

The feed supply pipe 116 comprises a rectangular tapered tube section 32 constituting a supply nozzle and a deformed tube section 33 leading thereto. An appropriate injection velocity may be attained if the inner transverse sectional area of the deformed tube 33 and the inner transverse sectional area of the narrowest part of the rectangular tapered tube 32 are set to provide a ratio of 20:1 to 1:1, preferably 10:1 to 2:1.

Figure 3:
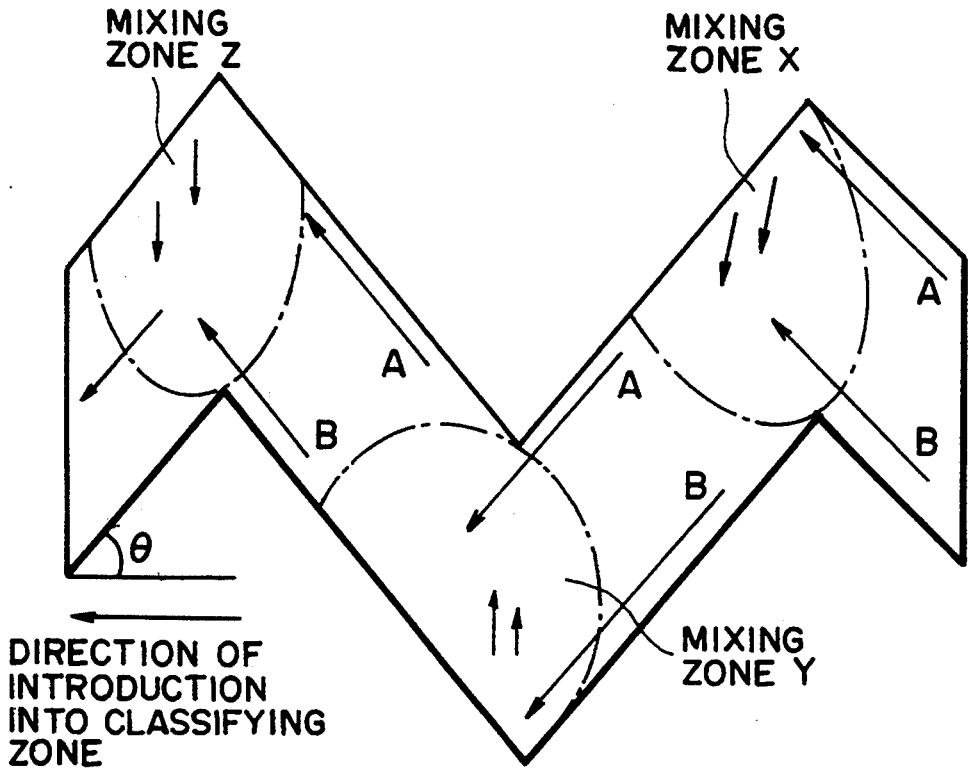
FIGS. 3, 5, 7, 9, 11, 13 and 15 are respectively a side sectional view of an embodiment of a deformed tube section.
Figure 4:
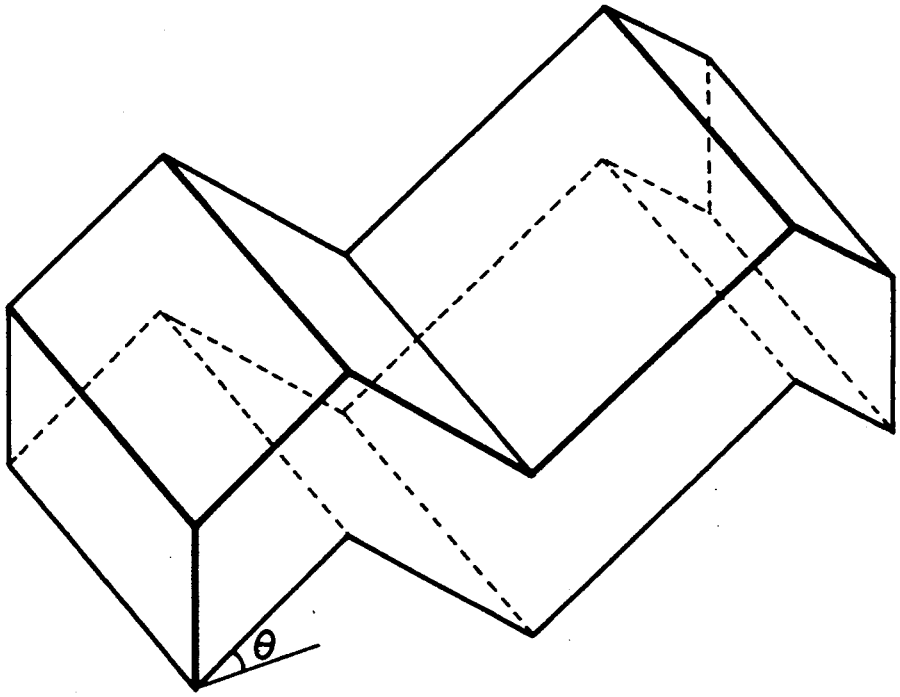
FIGS. 4, 6, 8, 10, 12, 14 and 16 are corresponding perspective views of the deformed tube sections shown in FIGS. 3, 5, 7, 9, 11, 13 and 15.

According to an embodiment, the deformed tube 33 of the feed supply pipe 116 may have a shape as shown in FIG. 3 (sectional view) and FIG. 4 (perspective view). The pipe is bent so as to be vertically zigzag, whereby the flow path of the powder is changed along the pipe walls. The powder introduced into the deformed tube 33 proceeds straight along the pipe wall and, at a mixing zone X where the pipe wall direction is changed, relatively fine powder in an upper stream A and relatively coarse powder in a lower stream B intersect each other to be mixed with each other. Thereafter, the mixed powder is subjected to further mixing in a mixing zone Y and in a mixing zone Z. Agglomerated particles are disintegrated by collision with other particles and the pipe walls. The thus mixed particles retain a uniform dust concentration within the pipe and are introduced into the classifying zone in such a state. The deformed tube 33 may preferably be disposed to provide a gas stream flowing in a direction forming an angle $\theta$ of 5–60 degrees, particularly 15–45 degrees, with respect to the direction of introduction into the classifying zone, i.e., the general flow direction, of the powder and the accompanying gas stream. In some specific cases, the angle $\theta$ may be given as an angle formed between the upper or/and lower wall of the deformed tube section at a downstream end thereof and direction of introduction of the feed powder and the accompanying gas stream into the classifying chamber. Two mixing zones are preferred to a single mixing zone because of a better dispersibility. However, too many mixing zones are liable to hinder the feed powder flow and cause an increased pressure loss. A particularly high feed powder dispersibility can be obtained in case of two to five mixing zones.

In the present invention, the above-mentioned direction of introduction of the feed powder and the accompanying gas stream into the classifying chamber may generally be most preferred to be a horizontal direction but can be inclined at an angle of within $\pm 30$ degrees, preferably within $\pm 20$ degrees, from the horizontal direction.

Figure 5:
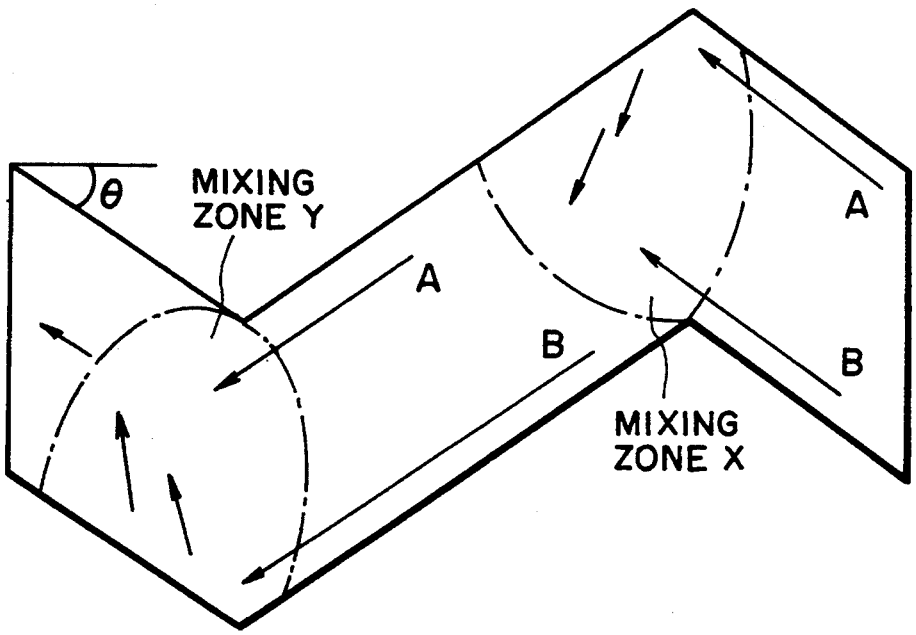

FIG. 3 shows a deformed tube having three mixing zones. FIGS. 5 (side sectional view) and 6 (perspective view) show an embodiment of deformed tube having two mixing zones X and Y where an upper stream A and a lower stream B intersect each other and a good dispersion is promoted by collision of particles with each other and with the pipe wall.

Figure 7:
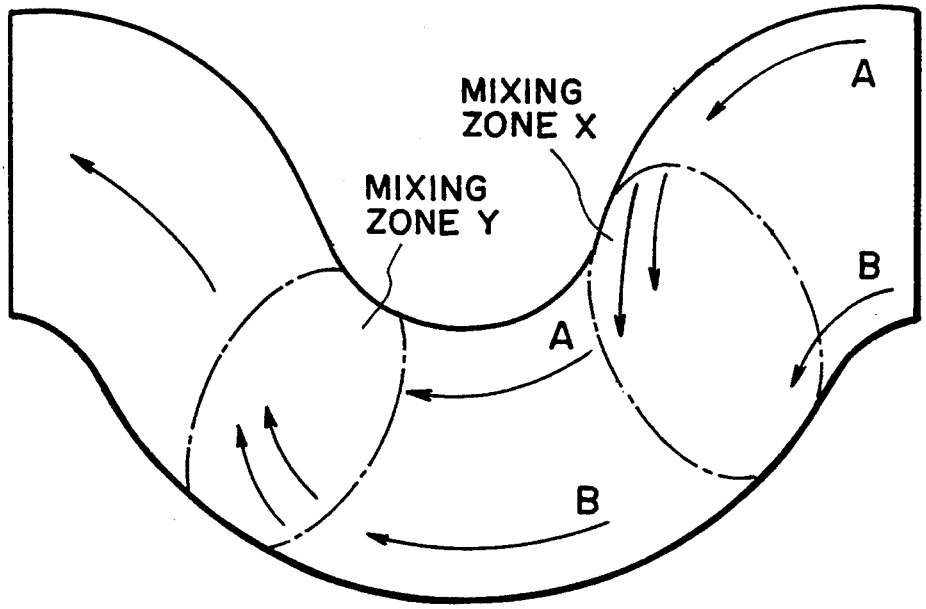
Figure 8:
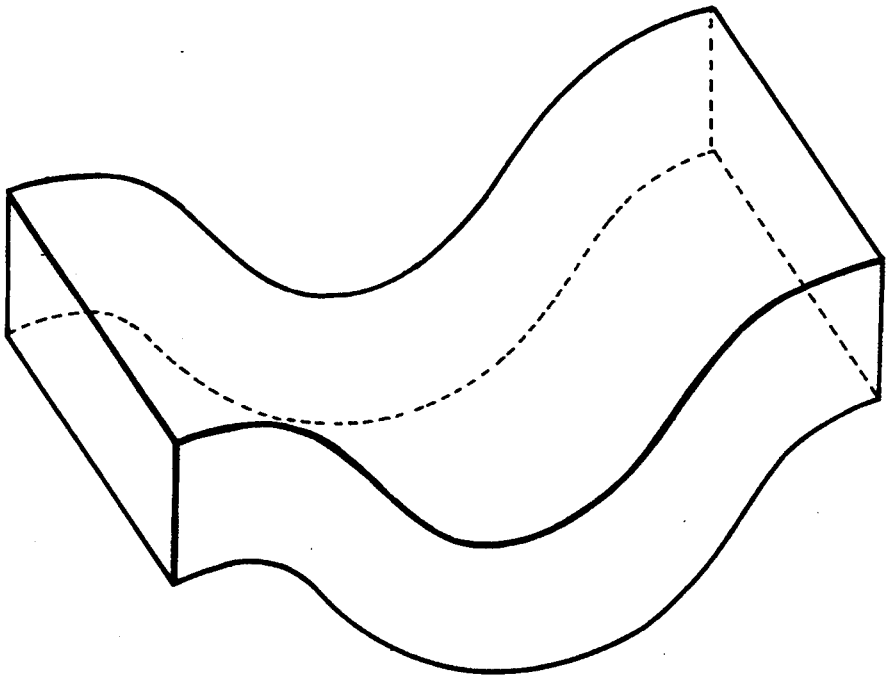
Figure 9:
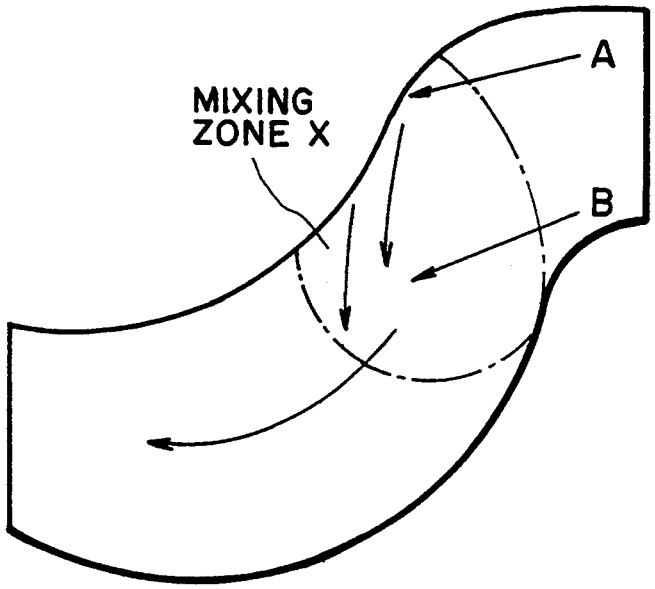
Figure 10:
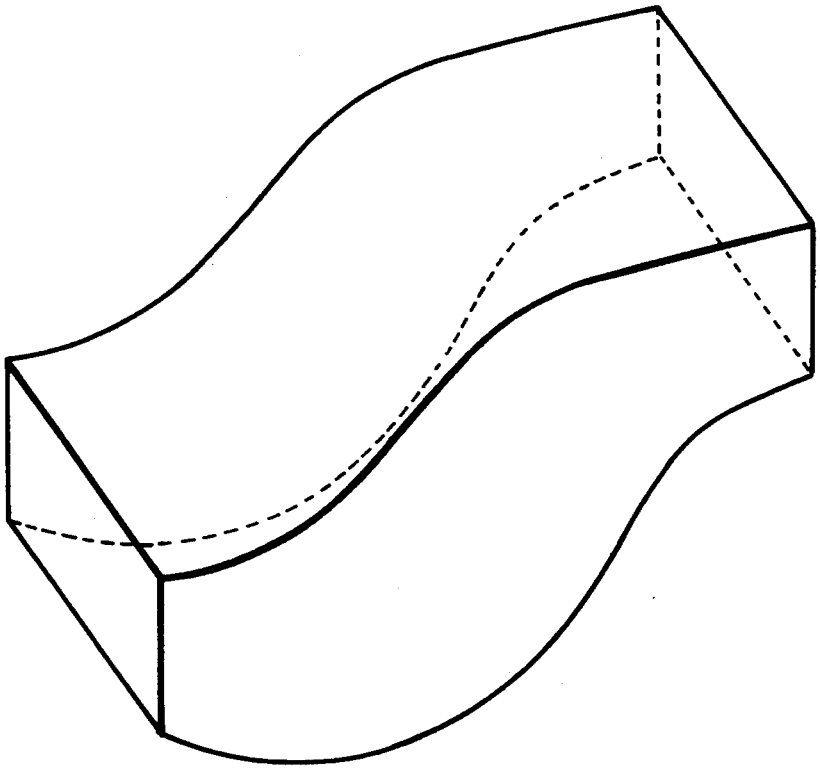

FIGS. 7 (side sectional view) and 8 (perspective view) show another embodiment of the deformed tube 33 of the feed supply pipe. The powder introduced into the deformed tube proceed along the pipe wall and impinge onto the walls in mixing zones X and Y to promote the dispersion. FIGS. 8 (side view) and 10 (perspective view) show another embodiment of the deformed tube 33 having a single mixing zone X. A better dispersion is attained in the case of two mixing zones.

Figure 11:
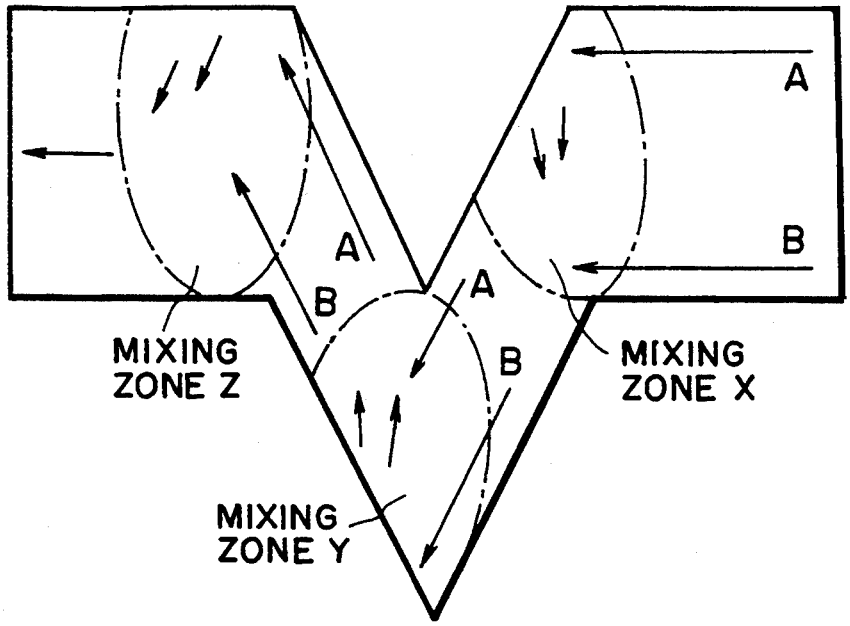
Figure 12:
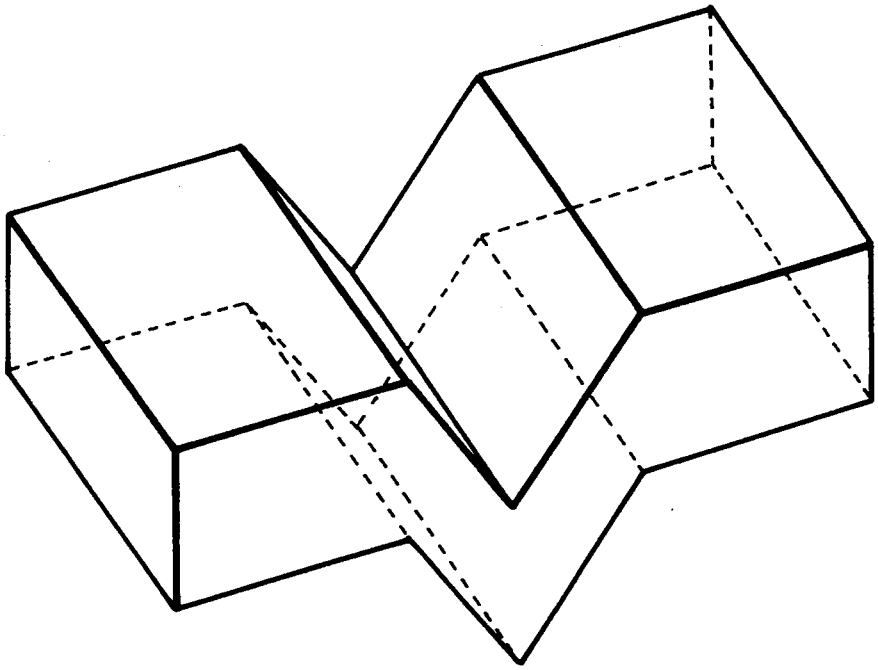

FIGS. 11 (side view) and 12 (perspective view) show an embodiment of the deformed tube having a generally, V-shaped including mixing zones X, Y and Z.

Figure 13:
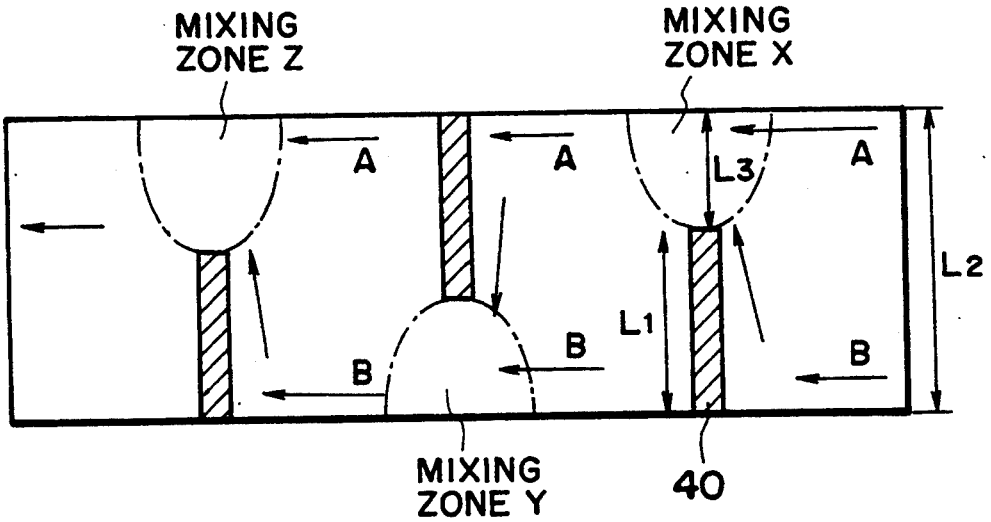

FIGS. 13 (side view) and 14 (perspective view) show another preferred embodiment of the deformed tube 33 which is formed by disposing flow path—control plates (baffles) 40 alternately on the upper inner wall and the lower inner wall. The flow path is changed by impingement onto plates 40 leaving gaps functioning as mixing zones X, Y and Z where the powder in an upper stream A and the powder in a lower stream B are mixed with each other. The flow path-control plate 40 may preferably have a length $L_1$ satisfying a relationship of $L_1 \geqq L_2 \times \frac{1}{2}$ with respect to the height $L_2$ of the deformed tube 33. The gas stream containing the feed powder is forced to change its path in a zigzag to promote the dispersion of the feed powder in the tube, and the agglomerate of the feed powder is disintegrated and dispersed by impingement onto the flow path-control plates. FIGS. 15 (side view) and 16 (perspective view) show a modification which is different from the embodiment shown in FIGS. 13 and 14 in outer shape of the deformed tube by which mixing zones X, Y, Z, $\alpha$ and $\beta$ are provided to mix an upper stream A and a lower stream B, thereby providing a uniform dust concentration through mixing of the coarse powder and the fine powder. The number and height of the flow path-control plates may be determined depending on the property of the powder to be treated. The position and the number of the baffles may be determined arbitrarily, but two mixing zones are preferred to a single mixing zone in order to provide a better dispersibility.

The effect of the present invention becomes more pronounced when the particle size of the feed powder is decreased. For example, the feed powder may preferably have a weight-average particle size of at most 10 μm, particularly at most 8 μm. This is particularly so for classification of toner feed powder.

The introduction of the feed powder together with a gas stream into the feed supply pipe 116 may be performed, e.g., (1) by applying a pressure of 0.1–3 kg/cm$^2$, (2) by disposing a suction fan of an enlarged capacity at a down-stream side of the classifying zone to apply a largely reduced pressure in the classifying zone to naturally suck the feed powder together with atmospheric air, or (3) by providing an injection feeder to the inlet of the powder feed for sucking the feed powder together with atmospheric air and injecting them to the classifying zone through the feed supply pipe 116. Among the above methods, the method (2) and/or (3) may preferably be adopted in the present invention in consideration of the apparatus and operation conditions.

The present invention is particularly effective for classification of particles containing at least 50% by number of particles with sizes of at most 20 μm to provide a toner for developing electrostatic images requiring a sharp particle size distribution and a high classification accuracy. The present invention is effective for classification into two divisions but even more effective for classification into multiple (three or more) divisions. Further, the present invention is particularly effective for classification for providing a toner having a weight-average particle size of at most 8 μm.

The operation in the multi-division classifier shown in FIG. 1 may for example be performed in the following manner. A reduced pressure is generated in the classifying chamber 90 by evacuation through at least one of the exhaust pipes 11, 12 and 13 and supplying the feed powder through the deformed tube section 33 and the rectangular tapered tube 32 opening into the classifying chamber 40 together with an accompanying gas stream flowing at a speed of 50 m/sec–300 m/sec under the action of the reduced pressure into the classifying chamber. As described above, in the present invention, the deformed tube section 33 is provided to cause a change in flow path of an upper stream and a lower stream and mixing of these streams within the pipe, thereby disintegrating the agglomerate, if any, within the feed powder and improving the dispersion of the feed powder to provide a better classification efficiency.

The feed powder thus supplied is caused to move along curved lines 30 due to the Coanda effect given by the Coanda block 26 and the action of the accompanying gas stream and, depending on the sizes of individual particles, is divided into a coarse powder fraction (over the prescribed particle size range) falling outwardly (i.e., outside the classifying edge 18), a medium particle fraction (within the prescribed size range) falling between the classifying edges 17 and 18, and a fine powder fraction (below the prescribed size range) falling inside the classifying edge 17. Then, the coarse powder fraction, the medium powder fraction and the fine powder fraction are discharged through the exhaust pipes 11, 12 and 13, respectively.

Figure 2:
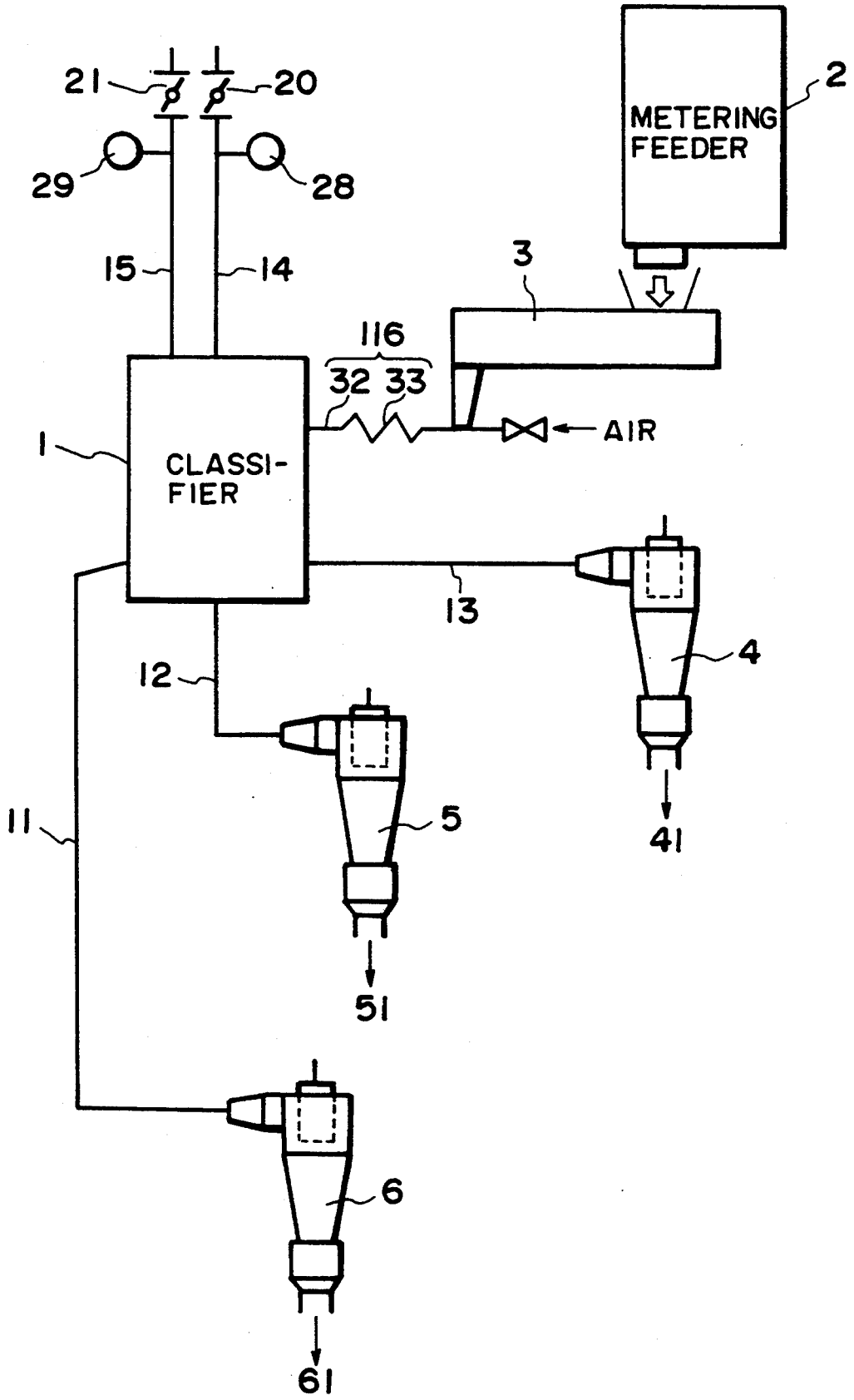
FIG. 2 is a schematic illustration of a classifying apparatus (system) including the classifier shown in FIG. 1.

In order to practice the above method, it is preferred to use an apparatus (system) including individual apparatus or instruments with communicating means, such as pipes. A preferred embodiment of such an apparatus (system) is shown in FIG. 2. The apparatus (system) shown in FIG. 2 includes a three-division classifier 1 (as shown in and described above with reference to FIG. 1), a metering feeder 2, a vibration feeder 3, and collecting cyclones 4, 5 and 6, connected with communication means.

In the apparatus, feed powder is supplied by appropriate means to the metering feeder 2 and, via the vibration feeder 3 and the feed supply pipe 116 (including the deformed tube section 33 and the rectangular tapered section 32), introduced into the three-division classifying means 1. The feed powder may preferably be introduced at a speed of 5–300 m/sec. The classifying means 1 generally include a classifying chamber having a size of [10–50 cm] ×[10–50 cm], so that the feed powder is divided into three (or more) fractions in an instant on the order of 0.1–0.01 sec or shorter. More specifically, the feed powder is divided into a coarse particle fraction (of particles above a prescribed size range), a medium particle fraction (of particles within the prescribed size range) and a fine particle fraction (of particles below the prescribed size range). Thereafter, the coarse particle fraction is discharged through an exhaust pipe 11 to be recovered by the collecting cyclone 6. The medium particle fraction is discharged through an exhaust pipe 12 to be recovered by the collecting cyclone 5 as a product 51. The fine particle fraction is discharged through an exhaust pipe 13 to be recovered by the collecting cyclone 4 as fine powder 41 outside the prescribed size range. The collecting cyclones 4, 5 and 6 also function as suction-reduced pressure means for generating a reduced pressure within the classifying means 1 for introducing under suction the feed powder through the feed supply pipe 116.

By using a classifier according to the present invention, it is possible to effectively classify a feed powder containing at least 50% by number of particles having a weight-average-particle size of at most 20 μm at a better efficiency than before.

Particularly, it is possible to classify a toner feed powder having a weight-average particle size of at most 10 μm, especially at most 8 μm, to obtain a toner having a sharp particle size distribution.

Figure 21:
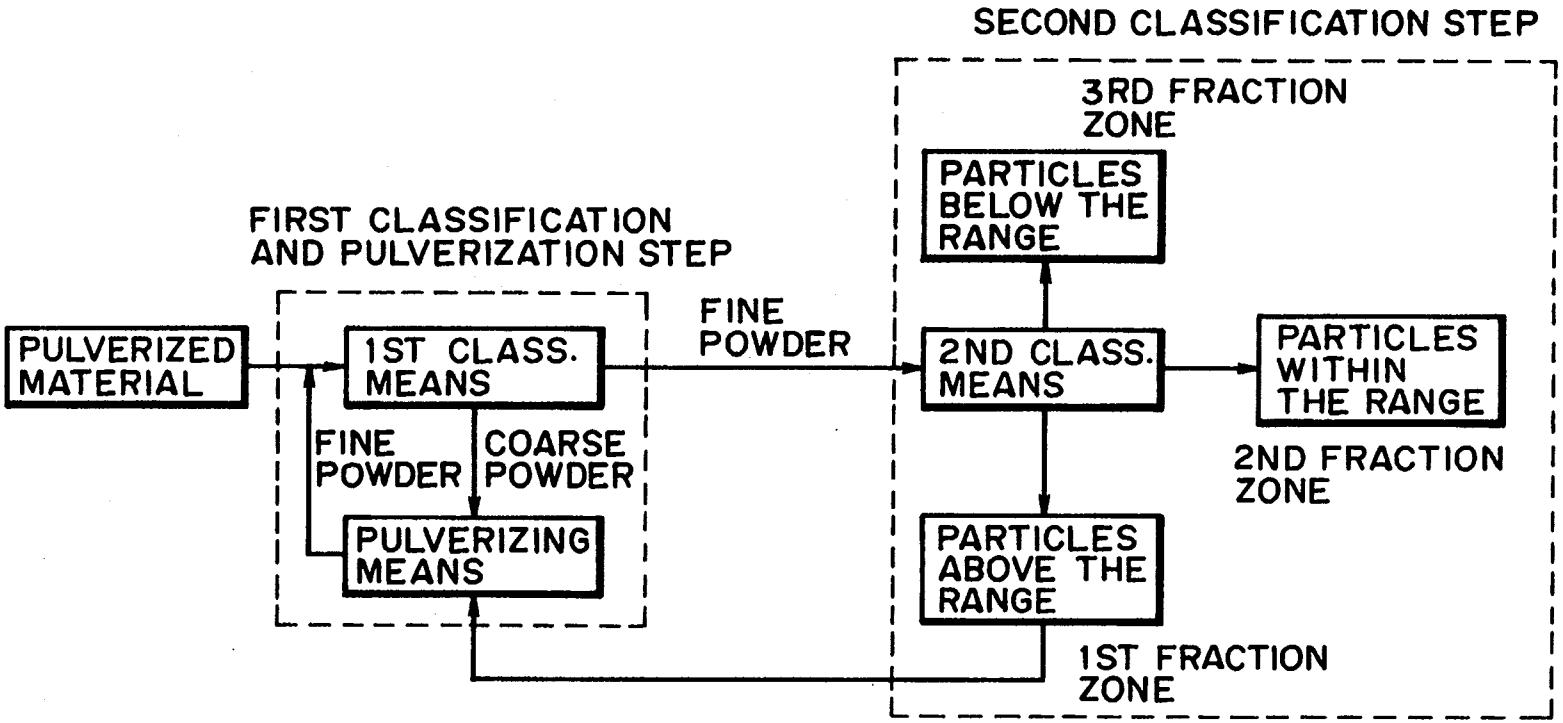
FIG. 21 is a flow chart for illustrating a toner production process according to the invention.

FIG. 21 is a flow chart illustrating an embodiment of the toner production process according to the present invention. Referring to FIG. 21, a prescribed quantity of pulverized feed is supplied to a first classifying means to be classified into coarse powder and fine powder.

The coarse powder is introduced into a pulverizing means to be pulverized and then recycled to the first classifying means. A prescribed amount of the fine powder is supplied to a second classifying means to be classified into at least a fine powder fraction, a medium powder fraction and a coarse powder fraction. A prescribed amount of the coarse powder fraction is introduced into the pulverizing means or the first classifying means. The classified medium powder fraction is used as a toner as it is or after being blended with an additive, such as hydrophobic colloidal silica. The classified fine powder fraction is generally re-utilized by being supplied to a melt-kneading step for producing the pulverized feed material or is simply discarded.

According to the production system of the present invention, it is possible to produce a small-particle size toner having a weight-average particle size of at most 10 μm, particularly at most 8 μm, through control of the classifying and pulverizing conditions.

Figure 22:
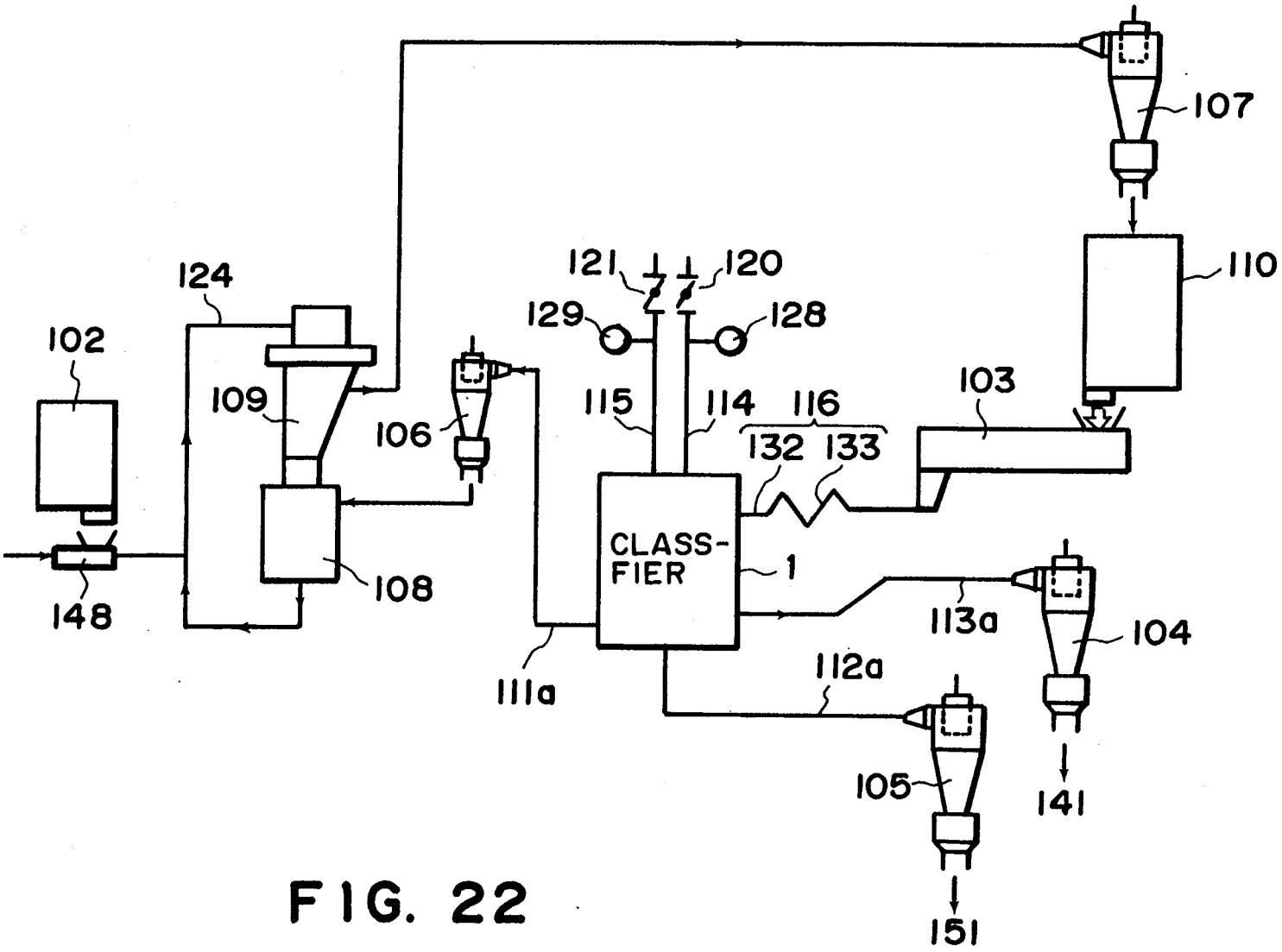
FIGS. 22 and 23 are respectively a schematic illustration of an embodiment of the toner production apparatus (system) according to the invention.
Figure 23:
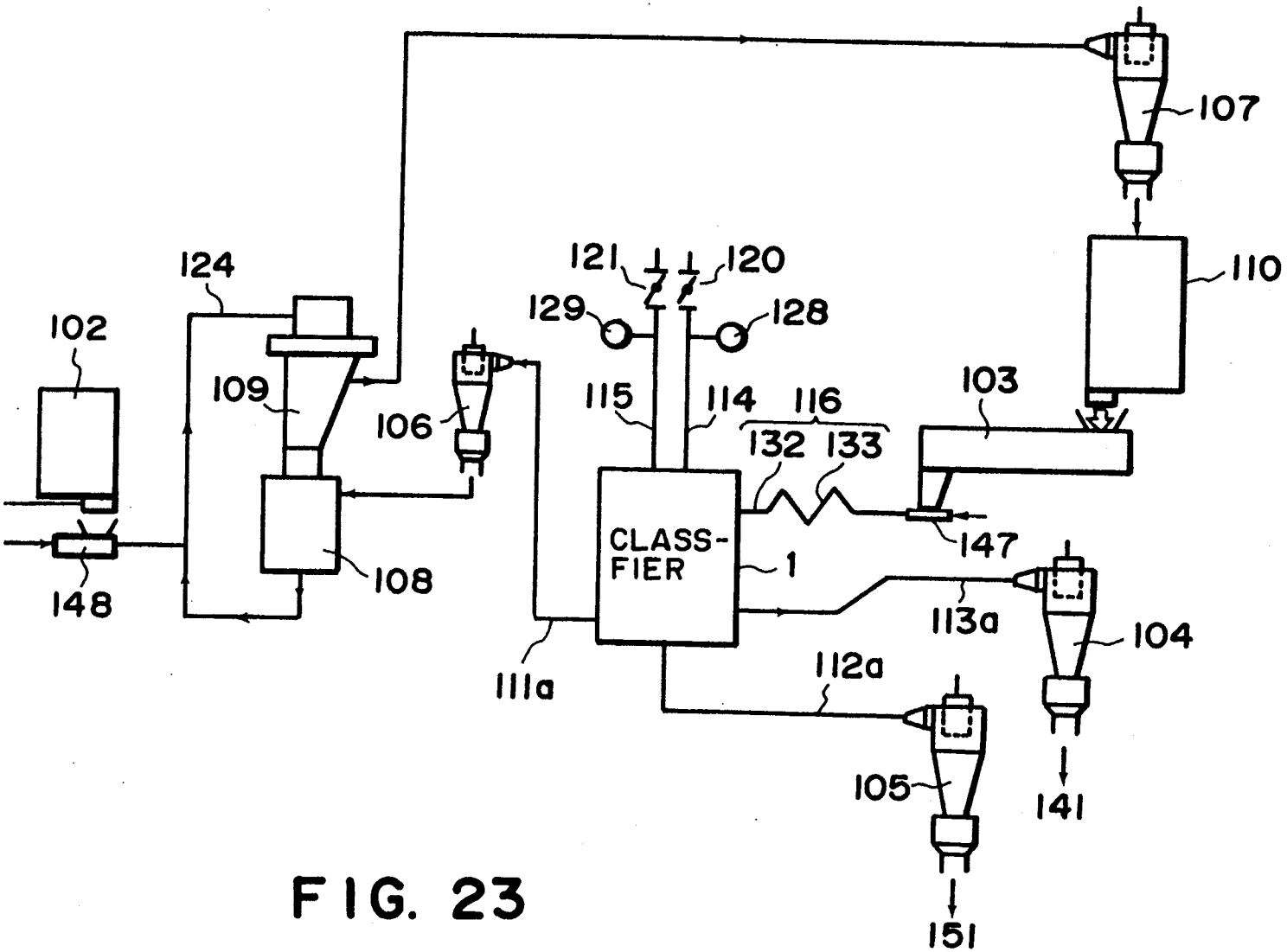

FIG. 22 shows an embodiment of the toner production apparatus (system) according to the present invention, and FIG. 23 shows a modification thereof.

Referring to these figures, a pulverized toner feed is introduced via a first metering feeder 102 into a first classifier 109, and the resultant classified fine powder is supplied via a collecting cyclone 107 to a second metering feeder 110 and then introduced into a multi-division classifier 1 via a vibration feeder 103 and a feed supply pipe 16. The classified coarse powder from the first classifier 109 is fed to a pulverizer 108 and, after being pulverized therein, recycled to the first classifier 109 together with a fresh pulverized feed.

The fine powder introduced into the multi-division classifier 1 is classified into a fine powder fraction, a medium powder fraction and a coarse powder fraction. The coarse powder fraction is, after being collected by a collecting cyclone 106, recycled to the pulverizer 108 (or the first classifier 109). The fine powder fraction and the medium powder fraction are collected by collecting cyclones 104 and 105, respectively.

Examples of the pulverizing means suitably used in the present invention may include an impinging gas stream pulverizer as shown in FIGS. 24–29.

Figure 24:
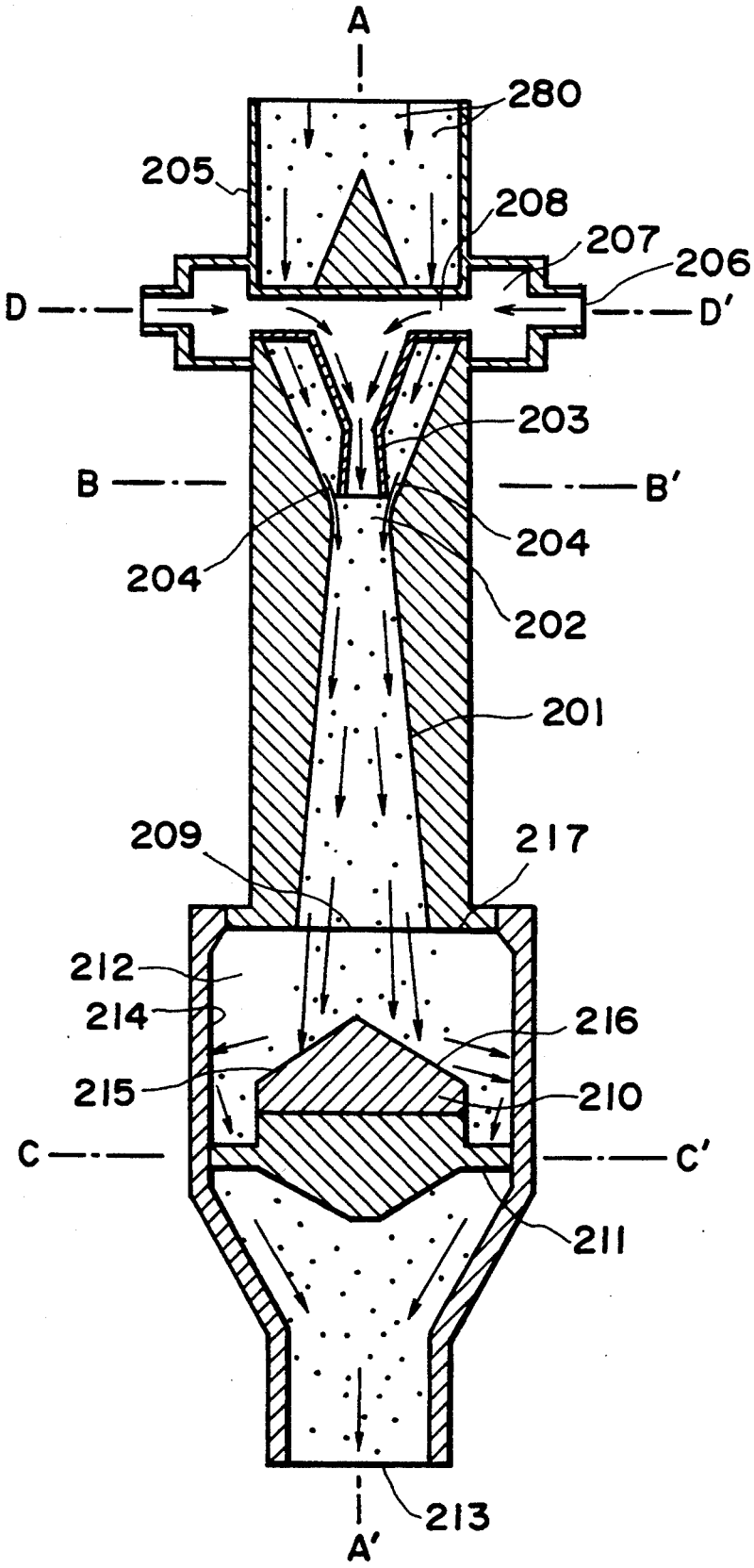
FIG. 24 is a schematic sectional view of a pulverizer as an embodiment of an impinging gas stream pulverizing means used in the invention.

Referring to FIG. 24, a pulverization feed (feed material to be pulverized) 280 supplied through a pulverization feed supply pipe 205 is supplied to an accelerating pipe 201 through a pulverization feed supply inlet 204 (also a throat) formed between an inner wall of an accelerating pipe throat 202 and an outer wall of a high pressure gas ejection nozzle 203.

It is preferred that the high pressure gas ejection nozzle 203 and the accelerating pipe 201 are substantially concentric (i.e., have central axes substantially aligned with each other).

On the other hand, a high-pressure gas is introduced from a high pressure gas inlet 206 and, via a high-pressure gas chamber 207 and preferably plural high pressure gas intake pipes 208, ejected from the high pressure gas ejection nozzle 203 toward an outlet 209 of the accelerating pipe 201 while causing abrupt expansion. At this time, due to an ejector effect occurring in the neighborhood of the accelerating pipe throat 202, the pulverization feed 280 together with an accompanying gas is accelerated from the pulverization feed supply inlet 204 toward the accelerating pipe outlet 209 while being uniformly mixed with the high pressure gas at the accelerating pipe throat 202, to impinge onto an impinging surface 216 of an impinging member 210 disposed opposite to the accelerating pipe outlet 209. An impact force occurring at the time of the impingement is imparted to sufficiently dispersed individual particles (of the pulverization feed 280), whereby a very efficient pulverization can be performed.

The pulverized material pulverized by the impinging surface 216 of the impinging member 210 is subjected to secondary impingement (or ternary impingement) with a side wall 214 of a pulverizing chamber 212 and then discharged out of a pulverized material exhaust 213 disposed behind the impinging member 210.

Figure 35:
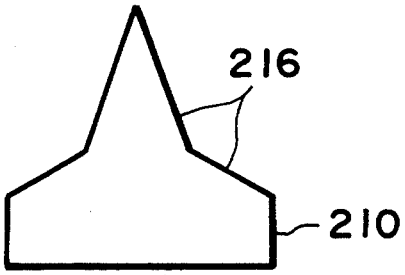
FIG. 35 is an illustration of the impinging member in FIG. 24 provided with a rectangularly tapered projection.
Figure 36:
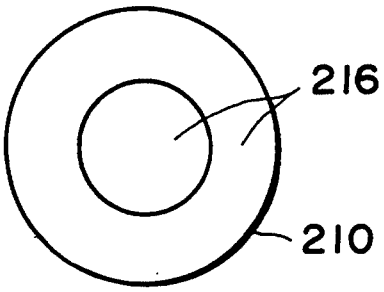
FIG. 36 is an illustration of the impinging member in FIG. 24 provided with a conical projection.
Figure 37:
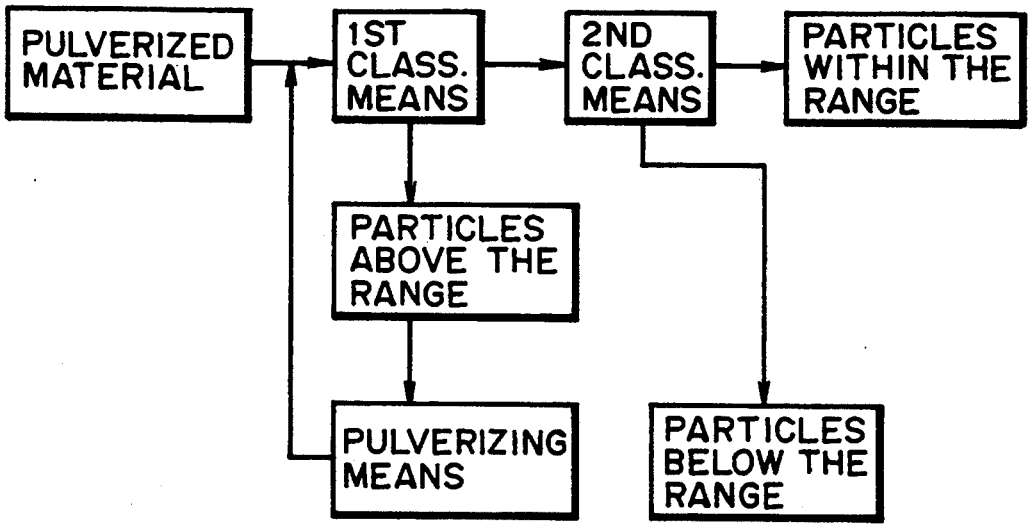
FIG. 37 PRIOR ART
FIG. 37 is a flow chart for illustrating a conventional toner production process.

It is preferred that the impinging surface 216 of the impinging member 210 is tapered as shown in FIG. 24 or provided with a conical (or rectangularly tapered) projection as shown in FIGS. 35 and 36, so as to disperse the pulverized material uniformly within the pulverizing chamber 212 and effectively cause the secondary impingement with the side wall 214. Further, if the pulverized material exhaust 213 is disposed at a rear position relative to the impinging member 210, the pulverized material can be discharged smoothly.

Figure 25:
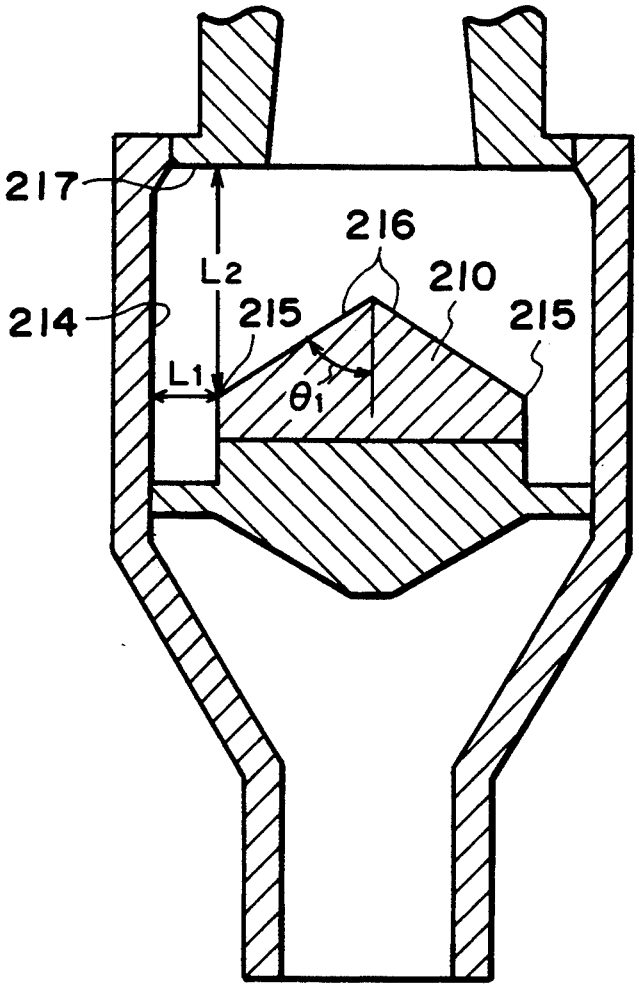
FIG. 25 is an enlarged sectional view of the pulverizing chamber shown in FIG. 24.

FIG. 25 is an enlarged view of the pulverizing chamber. Referring to FIG. 25, it is important that the closest distance $L_1$ between the peripheral edge 215 of the impinging member 210 and the side wall 214 is shorter than the closest distance $L_2$ between a front wall 217 and the peripheral edge 215 of the impinging member 210 so as not to increase the powder concentration in the vicinity of the accelerating pipe outlet 209 within the pulverizing chamber. Further, if the distance $L_1$ is shorter than the distance $L_2$, it is possible to effectively cause the secondary impingement of the pulverized material at the side wall. It is preferred that the impinging member 210 has an inclined impinging surface 216 forming an inclination angle $\theta_1$ with a longitudinal extension axis (central axis) of the accelerating pipe of less than 90 degrees, more preferably 55–87.5 degrees, further preferably 60–85 degrees, so as to effectively disperse the pulverized material and effectively cause the secondary impingement at the side wall 214.

Figure 26:
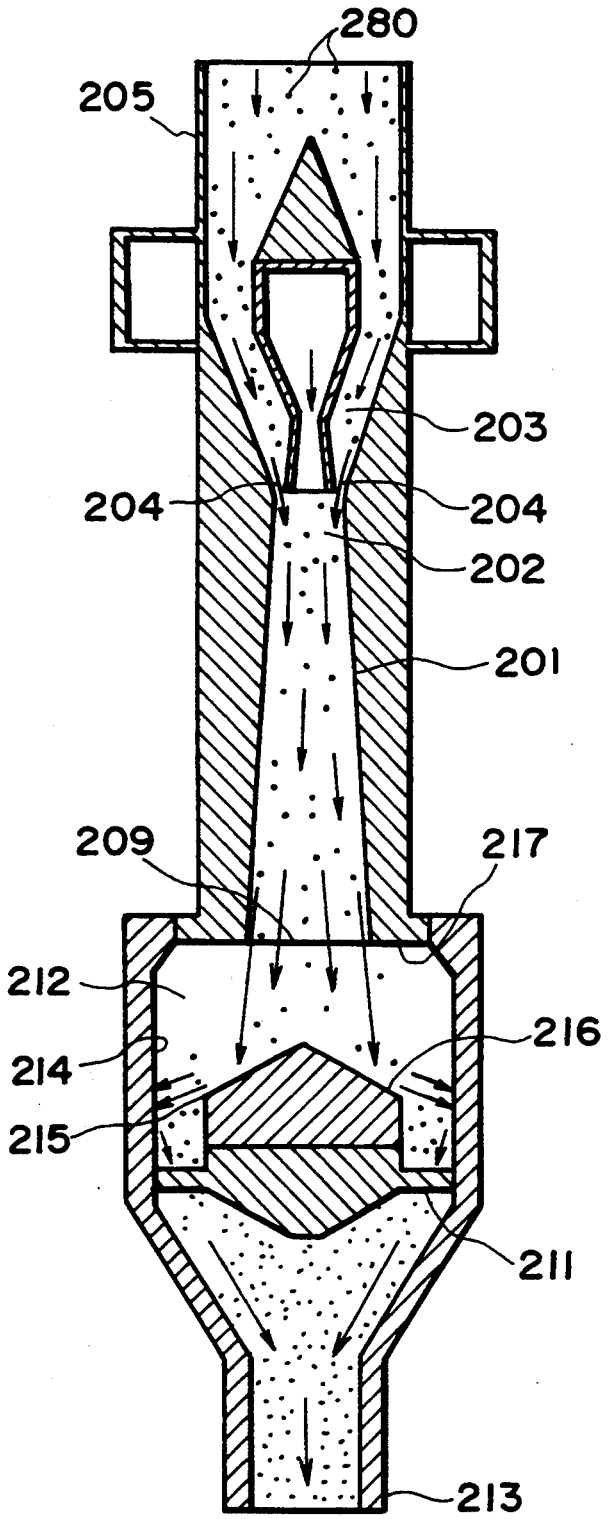
FIGS. 26, 27, 28 and 29 are sectional views showing an A—A′ section, a B—B′ section, a C—C′ section and a D—D′ section, respectively, of the pulverizer shown in FIG. 24.
Figure 38:
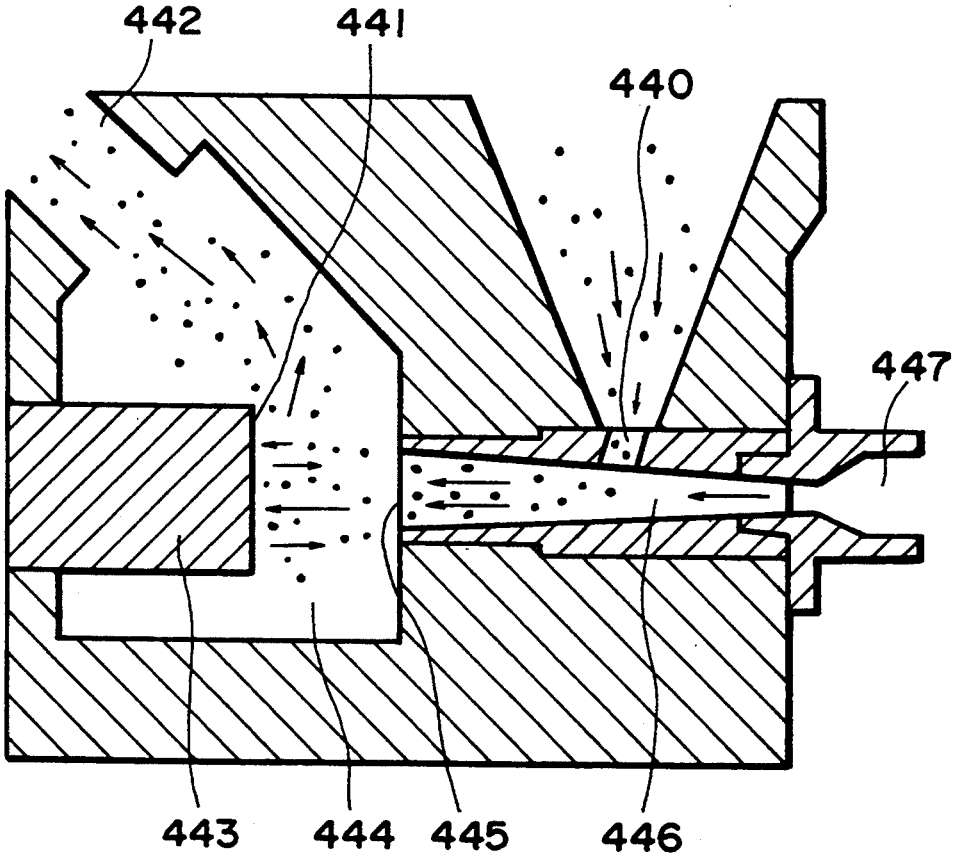
FIG. 38 is a schematic sectional view of a conventional impinging gas stream pulverizer.

Compared with a conventional pulverizer as shown in FIG. 38 wherein an impinging member 443 has a flat impinging surface 441 forming an angle of 90 degrees with respect to the axis of an accelerating pipe 446, the pulverizer having an inclined impinging surface 216 as shown in FIGS. 24–26 does not readily cause melt-sticking, agglomeration or coarsening of particles of a material to pulverized in case of pulverizing a resinous or sticky material. Further, the abrasion is not locally concentrated, so that the impinging member can be used for a longer period and stable operation becomes possible.

The accelerating pipe 201 may preferably be disposed so that its longitudinal axis is within an angle of 0–45 degrees with a vertical line, wherein the pulverization feed 280 is well treated without causing the clogging of the pulverization feed supply inlet 204.

In case of using a pulverization feed supply pipe 205 equipped with a conical member at its lower part for pulverizing a material with insufficient flowability, the feed material is liable to be stagnant at the lower part of the conical member while the amount is small. However, if the accelerating pipe is disposed to have an angle within the range of 0–20 degrees, preferably 0–5 degrees, with respect to a vertical line, the pulverization feed can be smoothly supplied to the pulverization feed without causing a stagnation thereof on the lower conical member.

FIG. 26 is a view of an A—A′ section in FIG. 24 and shows an appearance of smooth flow of the pulverization feed to the accelerating pipe 201.

Referring again to FIG. 25, the distance $L_2$ of the outermost part 215 of the impinging surface 216 from the accelerating pipe outlet 209 face may preferably be 0.2–2.5 times, more preferably 0.4–1.0 times, the diameter of the impinging member 210 in view of a good pulverization efficiency.

If the distance is below 0.2 times the diameter, the dust concentration in the vicinity of the impinging surface 216 can be abnormally increased in some cases. Above 2.5 times, the impacting force is liable to be weakened to lower the pulverization efficiency.

The shortest distance $L_1$ between the outermost edge 215 of the impinging member 210 and the side wall 214 may preferably be within the range of 0.1–2 times the diameter of the impinging member 210.

Below 0.1 times, a large pressure loss is liable to be caused for passing the high-pressure gas to lower the pulverization efficiency and the pulverized material does not flow smoothly. In excess of two times, the effect of secondary impingement of the pulverized material is liable to be lowered to lower the pulverization efficiency.

More specifically, the accelerating pipe may preferably have a length of 50–500 mm, and the impinging member 210 may preferably have a diameter of 30–300 mm.

Further, the impinging surface 216 of the impinging member 210 and the side wall 214 may preferably be composed of a ceramic material in view of the durability.

Figure 27:
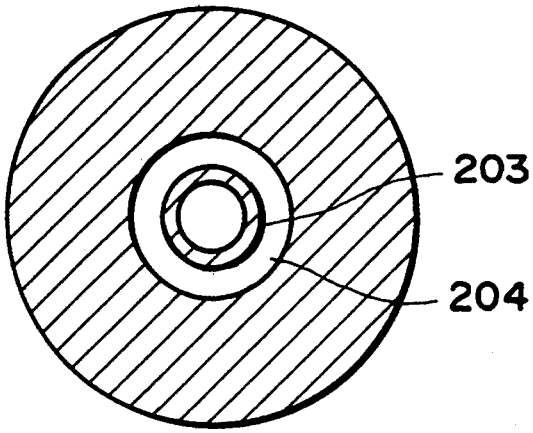

FIG. 27 is a view showing a B—B′ section in FIG. 24. Referring to FIG. 27, the distribution of the pulverization feed passing through the pulverization feed supply inlet 204 in a plane perpendicular to a vertical line is biased if the inclination of the accelerating pipe 201 to the vertical line is increased, so that the inclination is minimized to uniformize the distribution. It has been confirmed most suitable that the inclination of the accelerating pipe is within 0–5 degrees with respect to the vertical line by using a see-through accelerating pipe of acrylic resin for the accelerating pipe.

Figure 28:
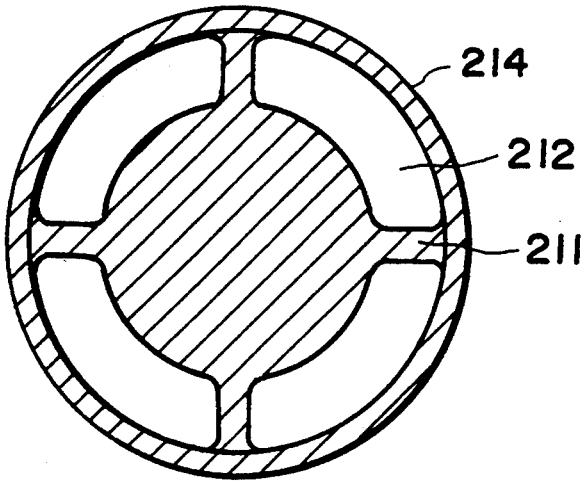

FIG. 28 shows a C—C′ section in FIG. 24. Referring to FIG. 28, the pulverized material is discharged through a part of the pulverizing chamber 212 between impinging member supports 211 and the side wall 214 toward the exhaust.

Figure 29:
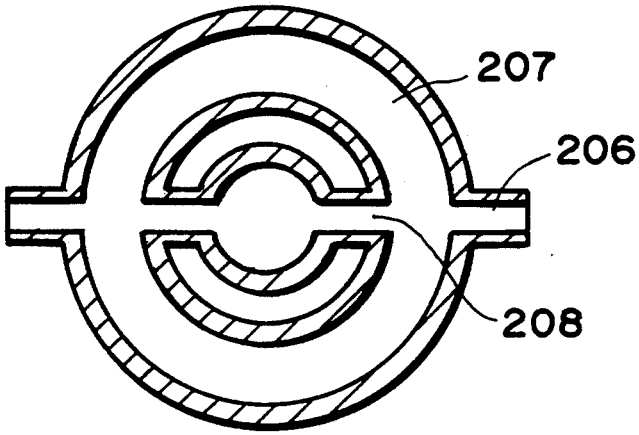

FIG. 29 shows a D—D′ section in FIG. 24. In FIG. 29, two high-pressure gas intake pipes 208 are disposed, but one or at least three intake pipes can be used as desired.

Figure 30:
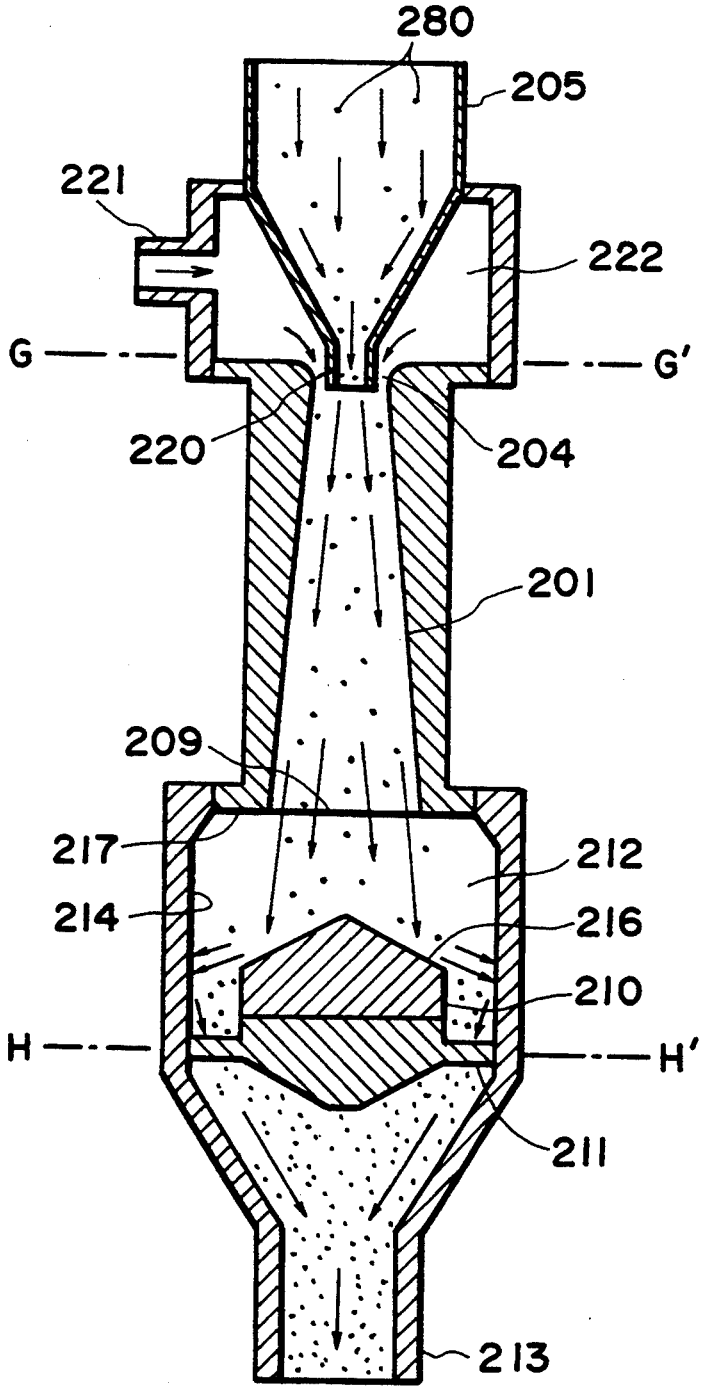
FIG. 30 is a schematic sectional view of a pulverizer as another embodiment of the impinging gas stream pulverizing means used in the invention.
Figure 31:
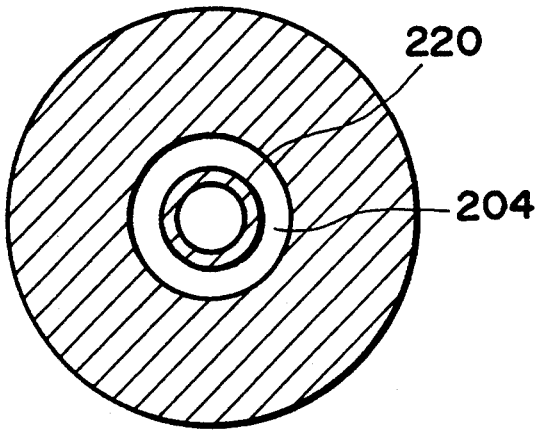
FIGS. 31 and 32 are sectional views showing a G—G′ section and a H—H′ section, respectively, of the pulverizer shown in FIG. 30.
Figure 32:
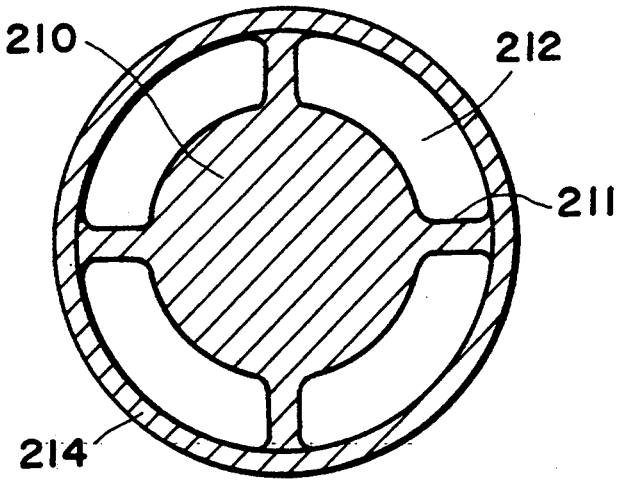

FIGS. 30–32 show another embodiment of the impinging gas stream pulverizer used in the present invention.

In FIG. 30, identical reference numerals denote identical members as in FIG. 24.

In the impinging gas stream pulverizer shown in FIG. 30, an accelerating pipe 201 is so disposed that its longitudinal axis has an inclination of 0–45 degrees, preferably 0–20 degrees, further preferably 0–5 degrees, and the pulverization feed 280 is supplied through a pulverization feed supply inlet 220 and an accelerating pipe throat 204 to an accelerating pipe 201. Into the accelerating pipe 201, a compressed gas such as compressed air is introduced through between the inner wall of the throat 204 and the outer wall of the pulverization feed supply inlet 220 so as to instantaneously accelerate the pulverization feed 280 supplied to the accelerating pipe 201 to a high speed. The pulverization feed 280 ejected at a high speed through the accelerating pipe outlet 209 into a pulverizing chamber 212 impinges onto an impinging surface 216 of an impinging member 210 to be pulverized.

If the impinging surface 216 of the impinging member 210 is tapered as shown in FIG. 30 or provided with a conical (or a rectangular tapered) projection as shown in FIGS. 25 and 26, the pulverized material after the impingement is dispersed well without causing melt-sticking, agglomeration or coarsening, and a pulverization at a high dust concentration becomes possible. Further, even if the pulverization feed is abrasive, the impinging surface or the pulverizing chamber inner wall 214 is not locally concentratively abraded, so that the life of these members can be prolonged and a stable operation becomes possible.

FIG. 31 shows a G—G′ section in FIG. 30. The pulverization feed 280 is supplied through the pulverization feed supply nozzle 220 to the accelerating pipe 201, and a high pressure gas is supplied through the throat 204 to the accelerating pipe 201.

FIG. 32 shows an H—H′ section in FIG. 30.

Figure 20:
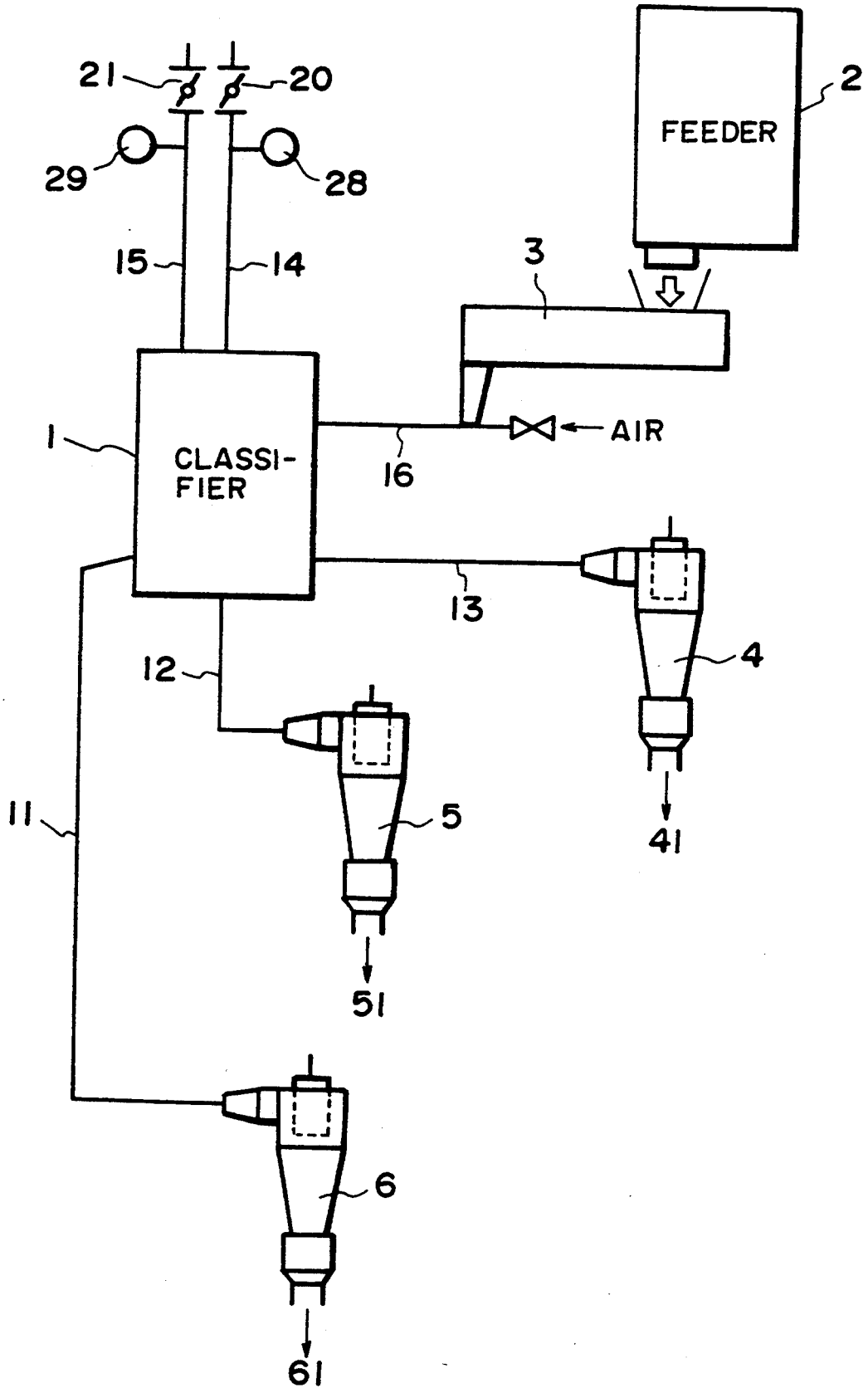
FIG. 20 is a schematic illustration of a classifying apparatus (system) including the conventional classifier shown in FIG. 17.

Similarly as the pulverizer shown in FIG. 20, the pulverization feed 280 can be processed without clogging the pulverization feed supply inlet 220 if the inclination of the longitudinal axis of the accelerating pipe is within the range of 0–45 degrees. However, in case where the pulverization feed has a poor fluidity, the pulverization feed is liable to be stagnant at a lower part of the pulverization feed supply pipe 205, so that the inclination of the accelerating pipe 201 may preferably be within the range of 0–20 degrees, further preferably 0–5 degrees, so as to obviate the stagnation of the pulverization feed 280 and smoothly supply the pulverization feed 280 into the accelerating pipe 201.

It has been observed that the pulverizer shown in FIG. 24 shows a better pulverization efficiency than the pulverizer shown in FIG. 30 because the pulverization feed 280 is supplied into the accelerating pipe 201 in a good dispersion state.

As the first classifying means used in the present invention, a gas stream classifier may be used. Examples thereof may include "DS-type Pulverizer" available from Nippon Pneumatic Kogyo K.K., and "Micron Separator" available from Hosokawa Micron K.K.

Figure 33:
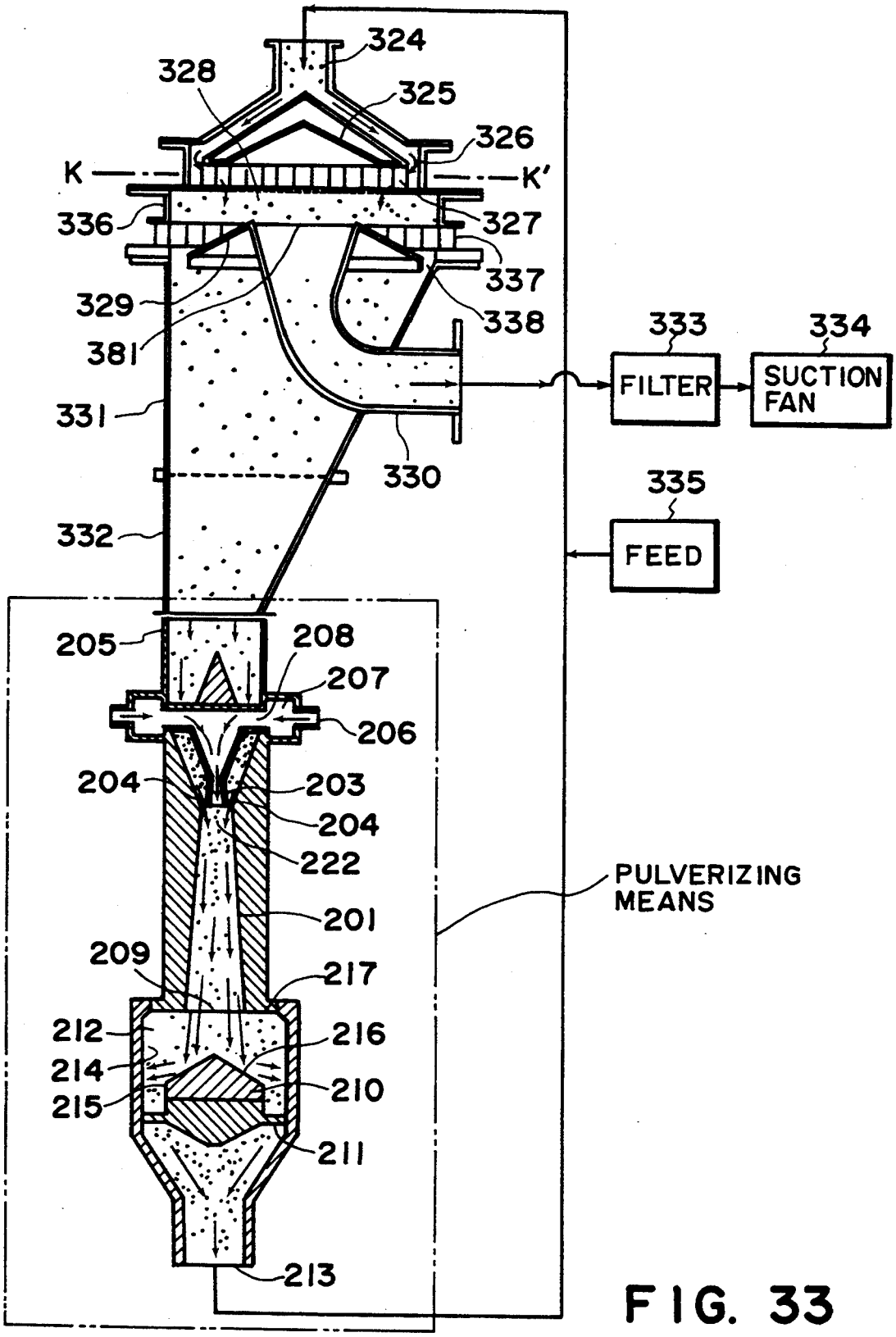
FIG. 33 is a schematic sectional view of a preferred embodiment of a first classifying means used in the toner production system according to the invention.

It is preferred to use a gas stream classifier as shown in FIG. 33 (and FIG. 34) together with a pulverizing means as described heretofore, in order to improve the classification accuracy into fine powder and coarse powder.

Referring to FIG. 33, the classifier includes a main casing 336 of a tubular structure and a lower casing 331, below which a coarse powder exhaust hopper 332 is connected. Inside the main casing 336 is formed a classifying chamber 328, and the upper part of the classifying chamber 328 is closed by an annular guide chamber 326 disposed above the main casing 336 and a conical (umbrella-shaped) upper cover 325 having a higher central part.

At a partitioning position between the classifying chamber 328 and the guide chamber 326, a guide louver 327 comprising a plurality of louver slats is disposed circumferentially, so that a powder feed and air supplied to the guide chamber 326 are caused to flow in a whirl into the classifying chamber 328 through between louver slats. The air and the powder feed introduced through a supply pipe 324 and flowing within the guide chamber 326 may preferably be distributed evenly to the individual louver slats 327 for accurate classification. The flow path until the guide louver 327 should be designed in a shape not causing a substantial condensation of the powder feed. In this embodiment, the supply pipe 324 is disposed to be connected to a horizontal plane of the classifying chamber 328 vertically from an upward position. This is not a limitative arrangement, however.

In this way, the air and the powder feed introduced through the guide louver 327 into the classifying chamber whereby a remarkably improved dispersion is attained at the time of introduction into the classifying chamber. The guide louver 327 is movably supported so that the spacing between the louver slats 327 can be adjusted.

At a lower part of the main casing 326 is disposed a classifying louver 337 so that classifying air is introduced via the classifying louver into the classifying chamber 328 so as to cause a whirling stream.

At the bottom of the classifying chamber is disposed a classifying plate 329 having a shape of cone (umbrella) having a larger height at its central part, and a coarse powder exhaust 338 is formed around the classifying plate 329. At a central part of the classifying plate is connected a fine powder exhaust pipe 330 having a fine powder intake opening 381. The lower part of the fine powder exhaust pipe 330 is bent in a L-shape, and the bent end is disposed outside the side wall of the lower casing 331. The exhaust pipe 330 is further connected via a fine powder recovery means 333, such as a cyclone or a dust collector, to a suction fan 334, by which a suction force is generated in the classifying chamber 328 to cause a whirling stream of sucked air flowing through the classifying louver 337 into the classifying chamber.

The gas stream classifier preferably used as a first classifying means has a structure as described above. In operation, an air stream containing a powder material comprising a powder material obtained by pulverization in an impinging gas stream as described above and shown below the gas stream classifier in FIG. 33 together with the exhaust air used for the pulverization and also a fresh pulverized feed, is supplied through the supply pipe 324 into the guide chamber 326. The air stream containing the powder material is caused to flow from the guide chamber 326 through the guide louver 327 into the classifying chamber 328 at a uniform concentration as a whirling stream.

The powder material thus whirling into the classifying chamber 328 is further subjected to an intensified whirling by an air stream sucked through the classifying louver 327 at a lower part of the classifying chamber 328 by the operation of the suction fan 334 connected to the fine powder exhaust pipe 330, whereby the powder material is centrifugally separated into coarse powder and fine powder under the action of a centrifugal force exerted to the respective particles. As a result, the coarse powder whirling along an outer peripheral part within the classifying chamber 328 is discharged through the coarse powder exhaust 338 and the lower hopper 332 to be supplied to the pulverization feed supply pipe 205. On the other hand, the fine powder moves along the upper sloping surface of the classifying plate 329 to the central part thereof and is discharged through the fine powder exhaust pipe 330 and recovered by the fine powder recovery means 333, from which the fine powder is sent to a second classifying means.

The air entering the classifying chamber 328 together with the powder material flows thereinto as a whirling stream. As a result, the particles whirling within the classifying chamber 328 have a velocity component toward the center which is relatively smaller than the centrifugal force, so that particles with a smaller particle size are separated effectively within the classifying chamber to effectively discharge such fine powder having very small particle sizes through the fine powder exhaust pipe 330. Further, as the powder material flows into the classifying chamber 328 at a substantially uniform concentration, powder having an accurate distribution can be recovered.

Figure 34:
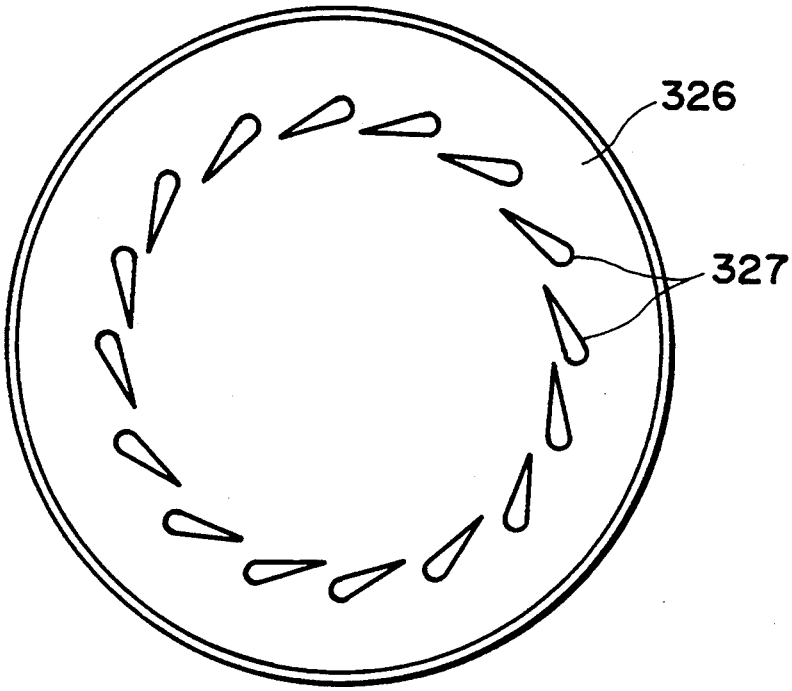
FIG. 34 is a K—K′ sectional view of the classifying means shown in FIG. 33.

FIG. 34 shows a K—K' section in FIG. 33 and shows an arrangement of guide louver slats 327.

As shown in FIG. 33, by combining the gas stream classifier and an impinging gas stream pulverizer as described above, the feeding of fine powder to the pulverizer is effectively prevented or suppressed, so that the over (excessive) pulverization of the powder material can be obviated. Further, the classified coarse powder is smoothly supplied to the pulverizer and is uniformly dispersed to the accelerating pipe to be well pulverized in the pulverizing chamber, so that the yield of the pulverized product and the energy efficiency per unit weight can be increased.

The second classifying means used for classifying the fine powder from the first classifying means may suitably be a classifier as shown in FIG. 1.

The pulverized feed supplied to the first classifying means may suitably have a particle size of at most 2 mm, preferably at most 1 mm. It is also possible to introduce the pulverized material into a medium pulverization step to pulverized into particles on the order of 10–100 μm, for introduction as a feed to the first classifying means.

In a conventional pulverization-classification process using a second classifying means solely for the purpose of removing a fine powder fraction, the powder material after the pulverization is required to be completely free from coarse particles exceeding a prescribed particle size. For this reason, the pulverization capacity in the pulverization step is required to be unnecessarily large, thus resulting in over pulverization and a lowering in pulverization efficiency.

This tendency is pronounced as the required particle size is lowered, particularly in obtaining a medium powder having a weight-average particle size of 3–10 μm.

In the process of the present invention, coarse particles and fine particles are simultaneously removed by using a multi-division classifying means. As a result, even if the powder material after the pulverization contains a certain proportion of coarse particles having a particle size exceeding a prescribed size, the coarse particles can be satisfactorily removed by the multi-division classifying means in a subsequent step, so that the pulverization suffers from little constraint in this respect and the pulverizer capacity can be utilized to the maximum, thus resulting in a good pulverization efficiency and litter liability of over-pulverization.

Accordingly, removal of the fine powder fraction can also be performed very effectively, thus resulting in a well increased classification efficiency.

In a conventional classification scheme aiming at classification into a medium powder fraction and a fine powder fraction, a long residence time is required in the classification step, while the agglomerates of fine particles causing a fog in developed images are liable to be produced. If such agglomerates are produced, it is generally difficult to remove them from the medium powder fraction. According to the process of the present invention, however, even if such agglomerates are entrained into the pulverized product, the agglomerates can be disintegrated into fine powder to be removed due to the Coanda effect and/or an impact accompanying the high-speed movement. Moreover, even if some agglomerates are not disintegrated, the agglomerates can be removed together with the coarse powder fraction, so that such agglomerates can be effectively removed from the objective medium powder fraction.

The process and apparatus according to the present invention may be suitably used for production of toner particles for developing electrostatic images.

Such a toner for developing electrostatic images can be produced through a process wherein toner ingredients, such as colorant or magnetic material powder, a binder resin of a vinyl-type or non-vinyl-type thermoplastic resin, optional charge control agent and other additives are sufficiently blended in a blender, such as a Henschel mixer or a ball mill; followed by melt-kneading by means of a hot kneader, such as a roller, a kneader or an extruder to dissolve or disperse the colorant or magnetic powder within the mutually dissolved resins; cooling for solidification; pulverization; and classification.

In the pulverization and classification steps, the process and apparatus of the present invention may be suitably applied.

The components of the toner will now be described.

For producing a toner suitably used in an image forming apparatus including a hot-pressure fixing apparatus or a hot-pressure roller fixing apparatus equipped with an oil applicator, the following binder resins may be used.

For example, polystyrene; homopolymers of styrene derivatives, such as poly-p-chlorostyrene and polyvinyltoluene; styrene copolymers, such as styrene-p-chlorostyrene copolymer, styrene-vinyltoluene copolymer, styrene-vinylnaphthalene copolymer, styrene-acrylate ester copolymers, styrene-methacrylate ester copolymers, styrene-α-chloromethacrylate ester copolymers, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyvinyl chloride, phenolic resin, natural and modified phenolic resins, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, coumarone-indene resin, and peroleum resin.

For a hot-pressure fixing scheme or a hot-pressure roller fixing scheme using no or substantially no oil application, an important problem is posed regarding a so-called offset phenomenon, i.e., a phenomenon of a part of toner image on a toner-image supporting member being transferred onto a fixing roller, or the adhesiveness of such a toner image onto a toner image supporting member. A toner fixed with a small heat energy is liable to cause blocking or caking during storage or in a developing apparatus, and these problems should also be considered. With these phenomena, the physical properties of the toner binder resin are most concerned. If the amount of a colorant, particularly a magnetic material is reduced, the adhesiveness of the toner onto a toner image-supporting member is increased, but the offsetting is liable to be caused and also blocking or caking. Accordingly, for producing a toner applied to a hot-pressure roller fixing scheme, the selection of a binder resin is more important. Preferred examples of the binder resin may include: crosslinked styrene copolymers and crosslinked polyesters.

Examples of the comonomer constituting styrene copolymers together with styrene monomer may include vinyl monomers, inclusive of: monocarboxylic acids having a double bond and substitution derivatives thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide, dicarboxylic acids and substitution derivatives, such as maleic acid, butyl maleate, methyl maleate, and dimethyl maleate; vinyl halides and vinyl esters, such as vinyl chloride, vinyl acetate and vinyl benzoate; vinyl ketones, such as vinyl methyl ketone, vinyl hexyl ketone; and vinyl ethers, such as vinyl methyl ether, vinyl ethyl ether, and vinyl isobutyl ether. These comonomers may be used singly or in combination of two or more species.

The crosslinking agent may primarily comprise a compound having at least two polymerizable double bonds. Examples thereof may include: aromatic divinyl compounds, such as divinylbenzene, and divinylnaphthalene; carboxylic esters having two double bonds, such as ethylene glycol diacrylate, ethylene glycol dimethacrylate, and 1,3-butanediol dimethacrylate; divinyl compounds, such as divinylaniline, divinyl ether and divinyl sulfide; and compounds having three or more vinyl groups. These may be used singly or in combination of two or more species.

For a pressure fixing scheme or a light heating-pressure fixing scheme, it is possible to use a binder resin for a pressure-fixable toner. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyesters, and paraffins.

It is preferred to incorporate (internally add) a charge control agent within toner particles. By using a charge control agent, it becomes possible to effect an optimum charge control depending on a developing system used. Particularly, it becomes possible to provide a stable balance between the charge and the particle size distribution. By using a charge control agent, it becomes possible to effect function separation for individual particle size ranges and mutual supplement required for providing a higher image formation. Examples of positive charge control agents may include: nigrosine and modified products thereof with, e.g., aliphatic acid metal salts; quarternary ammonium salts, such as tributylbenzylammonium-1-hydroxy-4-naphthosulfonate, and tetrabutylammonium tetrafluoroborate. These control agents may be used singly or in combination of two or more species.

It is also possible to use as a positive charge control agent a homopolymer or a copolymer with another polymerizable monomer as described above inclusive of styrene, acrylates, methacrylates, etc., of a monomer represented by the formula:

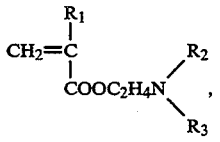

wherein $R_1$ denotes H or $CH_3$, and $R_2$ and $R_3$ denote a substituted or unsubstituted alkyl group (of preferably $C_1$–$C_4$). This type of charge control agent can also be used as a part or the whole of the binder resin.

The negative charge control agent may for example be an organometal complex or chelate compound. Examples thereof may include: aluminum acetylacetonate, iron (II) acetylacetonate: chromium or zinc 3,5-ditertiary-butylsalicylate. Particularly preferred classes of negative control agents may include acetylacetone metal complexes, and metal complexes and salts of salicylic acid or substituted salicylic acids. It is especially preferred to use metal complexes and salts of salicylic acids.

The above charge control agents (except for those used as a binder resin) may preferably be used in the form of fine particles, preferably having a number-average particle size of at most 4 μm, further preferably at most 3 μm.

In case of internal addition, the charge control agent may preferably be used in an amount of 0.1–20 wt. parts, particularly 0.2–10 wt. parts.

In case where a magnetic toner is prepared according to the present invention, the magnetic toner contains a magnetic material which may also function as a colorant. Examples of such a magnetic material may include: iron oxides, such as magnetite, γ-iron oxide, ferrite, and excessive iron-containing ferrite; metal, such as iron, cobalt and nickel, and alloys of these metals with another metal, such as aluminum, cobalt, copper, lead, magnesium, tin, zinc, antimony, beryllium, bismuth, cadmium, calcium, manganese, selenium, titanium, tungsten or vanadium. Mixtures of these magnetic materials can also be used.

The magnetic material may preferably have a number-average particle size of 0.1–1 μm, more preferably 0.1–0.5 μm. The magnetic material may be contained in a proportion of 60–110 wt. parts, preferably 65–100 wt. parts, per 100 wt. parts of the resinous component in the magnetic toner.

The colorant to be used in the present invention may comprise a known dye or pigment, examples of which may include: carbon black, Phthalocyanine Blue, Peacock Blue, Permanent Red, Lake Red, Rhodamine Lake, Hansa Yellow, Permanent Yellow and Benzidine Yellow. The colorant may be contained in a proportion of 0.1–20 wt. parts, preferably 0.5–20 wt. parts, per 100 wt. parts of the binder resin. For preparing a toner for producing an OHP transparency, the colorant may preferably be used in a proportion of at most 12 wt. parts, particularly 0.5–9 wt. parts, per 100 wt. parts of the binder.

By using the process and apparatus according to the present invention, it is possible to produce a toner containing at least 50% by number of particles having a weight-average particle size of at most 20 μm.

Particularly, it is possible to obtain a toner having a sharp particle size distribution from a powdery toner feed having a weight-average particle size of at most 10 μm, especially at most 8 μm.

Hereinbelow, the present invention will be described in further detail based on Examples.

EXAMPLES 1

Styrene/butyl acrylate/divinylbenzene copolymer (monomer wt. ratio=80.0/19.0/1.0, Mw (weight-average molecular weight)=$35\times10^4$ 100 wt. parts Magnetic iron oxide 100 wt. parts (Day. (average particle size)=0.18 μm) Nigrosin 2 wt. parts Low-molecular weight ethylene/propylene copolymer 4 wt. parts The above ingredients were blended thoroughly in a Henschel mixer ("FM-75", mfd. by Mitsui Miike Kakoki K.K.) and then kneaded by a twin-screw extruder ("PCM-30", mfd. by Ikegai Tekko K.K.) set at 150° C. The thus-kneaded product, after being cooled, was coarsely crushed by a hammer mill to 1 mm or smaller to form a crushed product, which was then pulverized by an impinging gas stream pulverizer (jet mill) to form a powder feed having a weight-average particle size of 7.2 μm.

The resultant powder feed was then introduced into a classifying system as shown in FIGS. 1 and 2. More specifically, the powder feed was introduced via a metering feeder 2 and a vibration feeder 3 (FIG. 2) and through a feed supply pipe 116 (comprising a deformed tube section 33 and a supply nozzle 32) at a rate of 34.0 kg/hr into a multi-division classifying means 1 (FIG. 1) for classifying the powder feed into three fractions including a coarse powder fraction, a medium powder fraction and a fine powder fraction.

The introduction of the powder feed was performed by utilizing a suction force exerted by a reduced pressure in the classifier 1 caused by operation of the collecting cyclones 4, 5 and 6 connected to exhaust pipes 11, 12 and 13, respectively, and a compressed air injected into the feed supply pipe 116.

The deformed tube section 33 of the feed supply pipe 116 had a shape shown in FIGS. 3 and 4 and having three mixing zones X, Y and Z. The angle $\theta$ with respect to the direction of introduction into the classifying zone was 30 degrees. By using a feed supply pipe of a transparent acrylic resin, the mixing of the upper stream A and the lower stream B was confirmed at the mixing zones X, Y and Z.

The powder feed was ejected into the classifying zone at a speed of about 90 m/sec.

The introduced powder feed was classified in an instant of at most 0.1 sec.

The classified medium powder fraction showed a weight-average particle size of 6.8 μm and a sharp distribution including 24% by number of particles with a particle size of at most 4.0 μm and 1.0% by volume of particles with a particle size of at least 10.08 μm, thus showing excellent properties as a toner powder.

The ratio of the finally obtained medium powder fraction to the total powder feed (i.e., classification efficiency) was 86%. The classified coarse powder was recycled to the above-mentioned pulverization step.

The particle size distribution data described herein are based on measurement using a Coulter counter as follows, while it may be measured in various manners.

Coulter counter Model TA-II (available from Coulter Electronics Inc.) is used as an instrument for measurement, to which an interface (available from Nikkaki K.K.) for providing a number-basis distribution and a volume-basis distribution, and a personal computer CX-1 (available from Canon K.K.) are connected. For measurement, a 1%-NaC1 aqueous solution as an electrolyte solution is prepared by using a reagent-grade sodium chloride. Into 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 μm by using the above-mentioned Coulter counter Model TA-II with a 100 micron-aperture to obtain a number-basis distribution. From the results of the number-basis distribution, the values of weight-average particle size, number-average particle size, etc., may be obtained.

EXAMPLE 2

A crushed product for toner production identical to the one prepared in Example 1 was pulverized by an impinging gas stream pulverizer (jet mill) to form a powder feed having a weight-average particle size of 6.4 μm.

Figure 6:
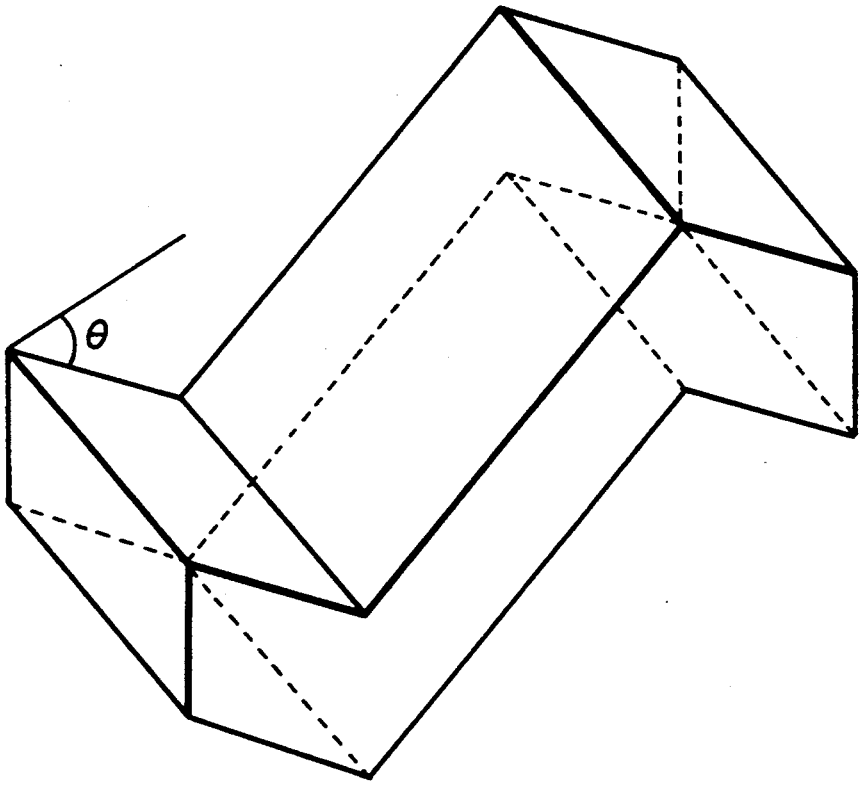

The powder feed was introduced to the same classifying system (FIGS. 1 and 2) as used in Example 1 except that the deformed tube section 33 of the feed supply pipe 116 was changed to one having a shape shown in FIGS. 5 and 6. As a result of observation through a transparent deformed tube 33 of an acrylic resin, the mixing of the upper and lower streams A and B was confirmed at mixing zones X and Y.

The powder feed was introduced into the multi-division classifier 1 at a rate of 32.0 kg/h to obtain a medium powder fraction having a weight-average particle size of 6.1 μm and having a sharp distribution (including 30% by number of particles with a particle size of at most 4.0 μm and 0.3% by volume of particles with a particle size of at least 10.08 μm) at a classification efficiency of 75%. The classified coarse powder was recycled to the pulverization step.

EXAMPLE 3

The same powder feed as in Example 1 was introduced into the classifying system used in Example 1 except that the deformed tube section 33 was changed to one having a shape shown in FIGS. 5 and 6 ($\theta=30$ degrees) providing two mixing zones X and Y. As a result of observation through a transparent deformed tube 33 of an acrylic resin, the mixing of the upper and lower streams A and B was confirmed at mixing zones X. and Y.

The powder feed was introduced into the multi-division classifier 1 at a rate of 32.0 kg/h to obtain a medium powder fraction having a weight-average particle size of 6.8 μm and having a sharp distribution (including 25% by number of particles with a particle size of at most 4.0 μm and 0.8% by volume of particles with a particle size of at least 10.08 μm) at a classification efficiency of 84%. The classified coarse powder was recycled to the pulverization step.

EXAMPLE 4

The same powder feed as in Example 1 was introduced into the classifying system used in Example 1 except that the deformed tube section 33 was changed to one having a shape shown FIGS. 7 and 8) providing two mixing zones X and Y. As a result of observation through a transparent deformed tube 33 of an acrylic resin, the mixing of the upper and lower streams A and B was confirmed at mixing zones X and Y.

The powder feed was introduced into the multi-division classifier 1 at a rate of 34.0 kg/h to obtain a medium powder fraction having a weight-average particle size of 6.8 μm and having a sharp distribution (including 25% by number of particles with a particle size of at most 4.0 μm and 0.8% by volume of particles with a particle size of at least 10.08 μm) at a classification efficiency of 84%. The classified coarse powder was recycled to the pulverization step.

EXAMPLE 5

Figure 14:
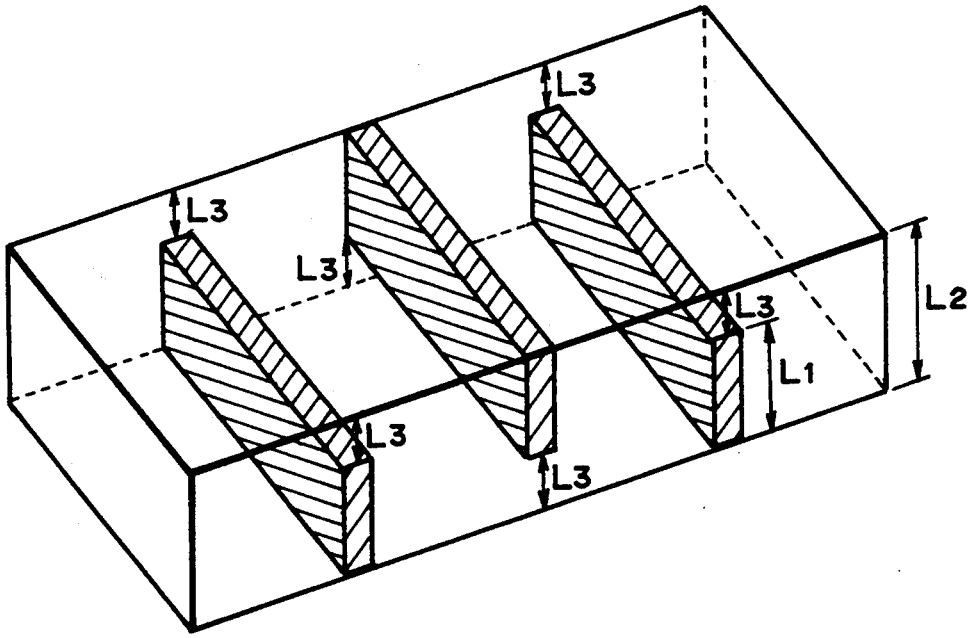
Figure 15:
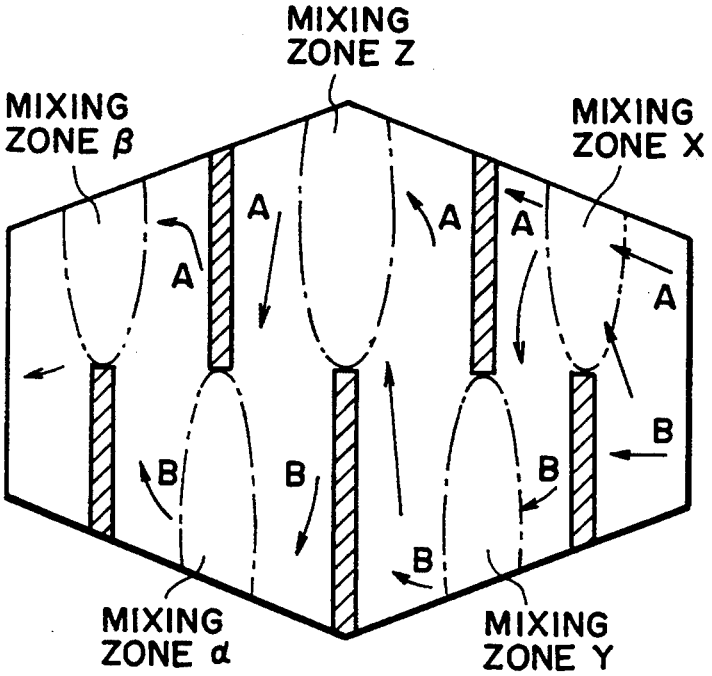
Figure 16:
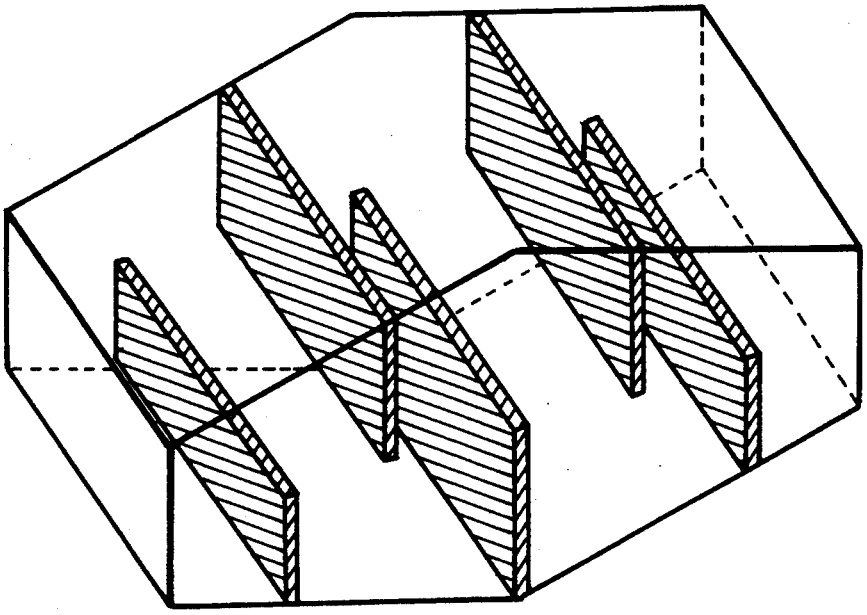

The same powder feed as in Example 1 was introduced into the classifying system used in Example 1 except that the deformed tube section 33 was changed to one having a shape shown FIGS. 13 and 14 so as to provide a flow path in a zigzag for air stream containing the powder feed. Three baffle plates 40 each having a height/tube height ($L_1/L_2$) ratio of ½ were disposed to provide three mixing zones X, Y and Z. As a result of observation through a transparent deformed tube 33 of an acrylic resin, the mixing of the upper and lower streams A and B was confirmed at mixing zones X, Y and Z.

The powder feed was introduced into the multi-division classifier 1 at a rate of 34.0 kg/h to obtain a medium powder fraction having a weight-average particle size of 6.8 μm and having a sharp distribution (including 23% by number of particles with a particle size of at most 4.0 μm and 1.0% by volume of particles with a particle size of at least 10.08 μm) at a classification efficiency of 86%. The classified coarse powder was recycled to the pulverization step.

EXAMPLES 6

| | |
|---|---|
| Unsaturated polyester resin | 100 wt. parts |
| Copper phthalocyanine pigment (C.I. Pigment Blue 15) | 4.5 wt. parts |
| Charge control agent | 4.0 wt. parts |

The above ingredients were blended well in a Henschel mixer ("FM-75", mfd. by Mitsui Miike Kakoki K.K.) and then kneaded by a twin-screw extruder ("PCM-30", mfd. by Ikegai Tekko K.K.) set at 100° C. The thus-kneaded product, after being cooled, was coarsely crushed by a hammer mill to 1 mm or smaller to form a crushed product, which was then pulverized by an impinging gas stream pulverizer (jet mill) to form a powder feed having a weight-average particle size of about 6.5 μm.

The resultant powder feed was then introduced into a classifying system as shown in FIGS. 1 and 2. More specifically the powder feed was introduced via a metering feeder 2 and a vibration feeder 3 (FIG. 2) and through a feed supply pipe 116 (comprising a deformed tube section 33 and a supply nozzle 32) at a ratio of 30.0 kg/hr into a multi-division classifying means 1 (FIG. 1) for classifying the powder feed into three fractions including a coarse powder fraction, a medium powder fraction and a fine powder fraction.

The introduction of the powder feed was performed by utilizing a suction force exerted by a reduced pressure in the classifier 1 caused by operation of the collecting cyclones 4, 5 and 6 connected to exhaust pipes 11, 12 and 13, respectively, and a compressed air injected into the feed supply pipe 116.

The deformed tube section 33 of the feed supply pipe 116 had a shape shown in FIGS. 3 and 4 and having three mixing zones X, Y and Z. By using a feed supply pipe of a transparent acrylic resin, the mixing of the upper stream A and the lower stream B was confirmed at the mixing zones X, Y and Z.

The powder feed was ejected into the classifying zone at a speed of about 90 m/sec. The introduced powder feed was classified in an instant of at most 0.1 sec.

The classified medium powder fraction showed a weight-average particle size of 6.5 μm and a sharp distribution including 25% by number of particles with a particle size of at most 4.0 μm and 1.0% by volume of particles with a particle size of at least 10.08 μm, thus showing excellent properties as a toner powder.

The classification efficiency at this time was 82%. The classified coarse powder was recycled to the above-mentioned pulverization step.

COMPARATIVE EXAMPLE 1

Figure 17:
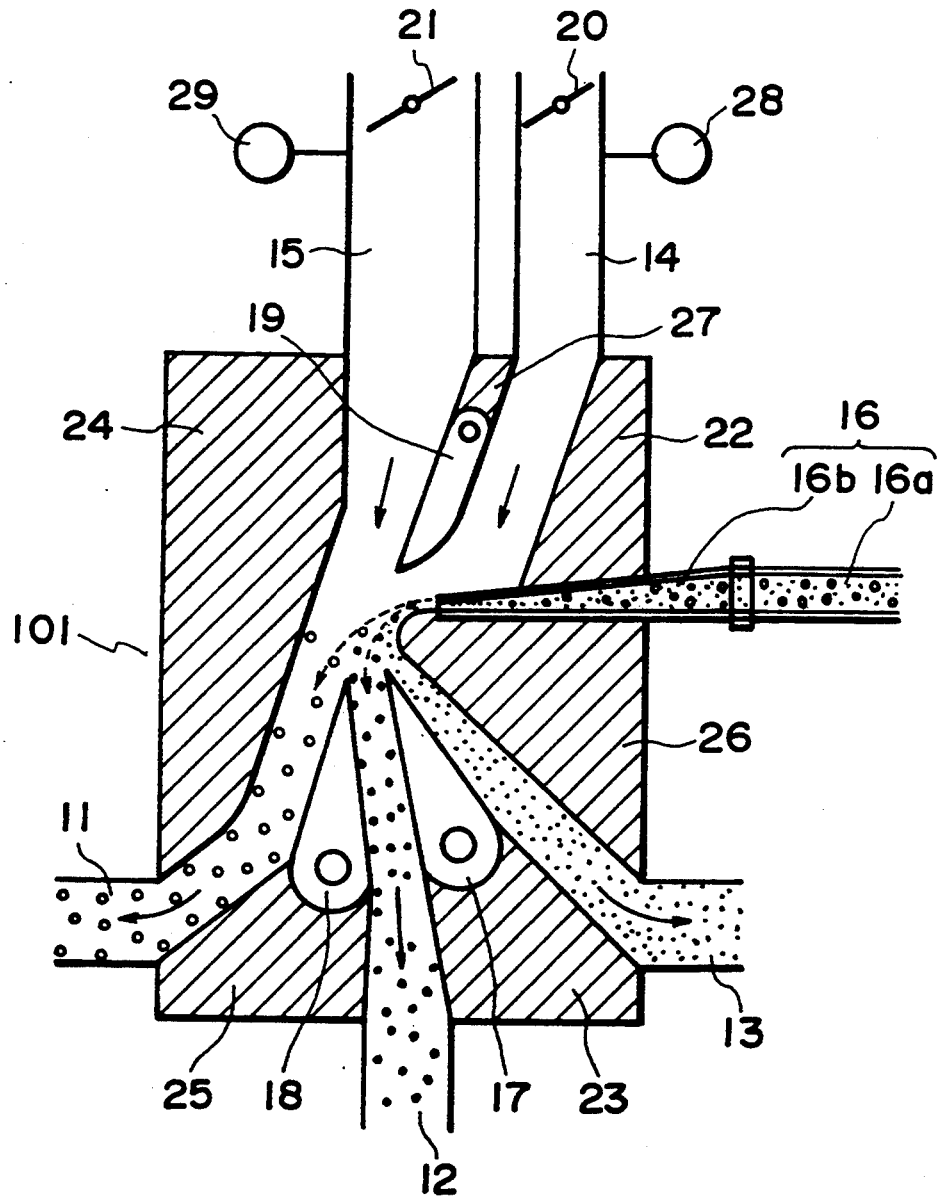
FIG. 17 is a side sectional view of a gas stream classifier having a conventional feed supply pipe.

The same powder feed as in Example 1 was introduced into a classifying system as shown in FIG. 20 including a multi-division classifier 101 as shown in FIG. 17 for the classifier 1 in FIG. 20.

More specifically, the powder feed was introduced via a metering feeder 2 and a vibration feeder 3 (FIG. 20) and through a feed supply pipe 16 (comprising a straight tube section 16*a* and a supply nozzle 16*b*) at a rate of 30.0 kg/hr into a multi-division classifying means 101 (FIG. 17) for classifying the powder feed into three fractions including a coarse powder fraction, a medium powder fraction and a fine powder fraction.

The introduction of the powder feed was performed by utilizing a suction force exerted by a reduced pressure in the classifier 101 caused by operation of the collecting cyclones 4, 5 and 6 connected to exhaust pipes 11, 12 and 13, respectively, and a compressed air injected into the feed supply pipe 16.

Figure 18:
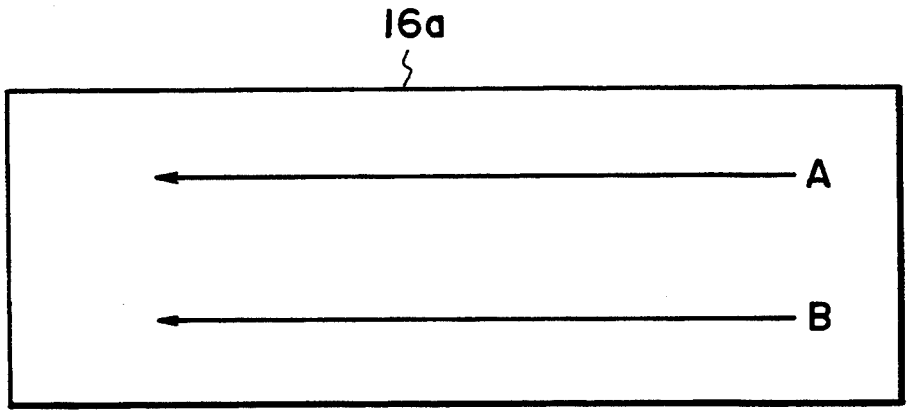
FIGS. 18 and 19 are a side sectional view and a perspective view, respectively, of a conventional linear tube section.
Figure 19:
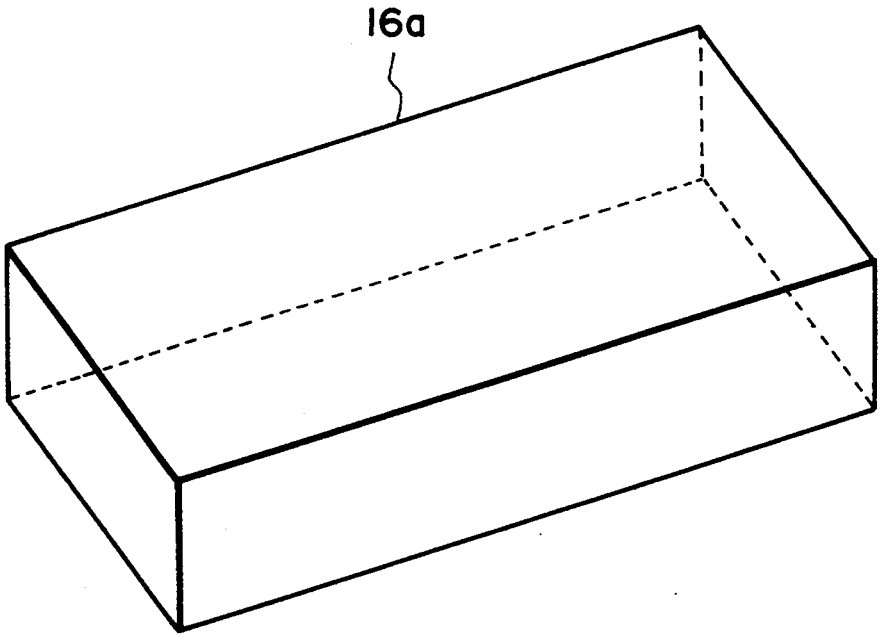

The straight tube section 16*a* of the feed supply pipe 16 had a shape shown in FIGS. 18 and 19. By using a feed supply pipe of a transparent acrylic resin, it was confirmed that the upper stream A and the lower stream B were not mixed with each other but flowed in separate streams.

As a result, there was obtained a medium powder fraction having a weight-average particle size of 6.9 μm and having a particle size distribution (including 27% by number of particles with a particle size of at most 4.0 μm and 1.5% by volume of particles with a particle size of at least 10.08 μm) at a classification efficiency of 81%. The classified coarse powder was recycled to the pulverization step.

Compared with Example 1, the medium powder fraction showed a broader particle size distribution, yet was obtained at a somewhat lower classification efficiency, whereas the introduction rate of the powder fed was lower.

COMPARATIVE EXAMPLE 2

The same toner feed as in Example 2 was subjected to classification in the classification system used in Comparative Example 1 (FIGS. 17 and 20) using a straight tube section 16*a*.

More specifically, the powder feed was introduced into the multi-division classifier at a rate of 30.0 kg/h to obtain a medium powder fraction having a weight-average particle size of 6.1 μm and including 33% by number of particles with a particle size of at most 4.0 μm and 0.5% by volume of particles with a particle size of at least 10.08 μm) at a classification efficiency of 70%. The classified coarse powder was recycled to the pulverization step.

Compared with Example 2, the medium powder fraction showed a broader particle size distribution, yet was obtained at a somewhat lower classification efficiency, whereas the introduction state of the powder feed was lower.

COMPARATIVE EXAMPLE 3

The same toner feed as in Example 6 was subjected to classification in the classification system used in Comparative Example 1 (FIGS. 17 and 20) using a straight tube section 16*a*.

More specifically, the powder feed was introduced into the multi-division classifier at a rate of 25.0 kg/h to obtain a medium powder fraction having a weight-average particle size of 6.5 μm and (including 28% by number of particles with a particle size of at most 4.0 μm and 1.6% by volume of particles with a particle size of at least 10.08 μm) at a classification efficiency of 76%. The classified coarse powder was recycled to the pulverization step.

Compared with Example 6, the medium powder fraction showed a broader particle size distribution, yet was obtained at a somewhat lower classification efficiency, whereas the introduction state of the powder feed was lower.

As described above, according to the gas stream classifying method and apparatus of the present invention, it has become possible to effect a high accuracy classification and obtain a powder having a precise particle size distribution, particularly a toner containing at least 50% by number of particles having a particle size of at most 20 μm at a good efficiency.

Particularly, it has become possible to obtain a toner having a sharp particle size distribution from a toner powder feed having a weight-average particle size of at most 10 μm, especially at most 8 μm, at a good efficiency.

EXAMPLES 7

| | |
|---|---|
| Styrene/butyl acrylate/divinylbenzene copolymer (monomer wt. ratio = 80.0/19.0/1.0, Mw = $35 \times 10^4$ | 100 wt. parts |
| Magnetic iron oxide (Dav. (average particle size) = 0.18 μm) | 100 wt. parts |
| Nigrosin | 2 wt. parts |
| Low-molecular weight ethylene/propylene copolymer | 4 wt. parts |

The above ingredients were blended well in a Henschel mixer ("FM-75", mfd. by Mitsui Miike Kakoki K.K.) and then kneaded by a twin-screw extruder ("PCM-30", mfd. by Ikegai Tekko K.K.) set at 150° C. The thus-kneaded product, after being cooled, was coarsely crushed by a hammer mill to 1 mm or smaller to form a crushed toner material.

The crushed toner material was introduced into an apparatus system shown in FIG. 23 for pulverization and classification.

The system included an impinging gas stream pulverizer 108 having a structure as shown in FIG. 24. The pulverizer included an accelerating pipe 201 having an inclination of its longitudinal axis with respect to a vertical line (hereinafter called an "accelerating pipe inclination") of about 0 degree (i.e., disposed substantially vertically), an impinging member 210 having a conical impinging surface 216 forming an apex angle of 160 degrees and an outer diameter of 100 mm, and a cylindrical pulverizing chamber 212 having an inner diameter of 150 mm. The minimum distance $L_2$ (FIG. 25) between the outermost peripheral part of the impinging surface and the outlet plane 217 of the accelerating pipe was 50 mm, and the minimum distance $L_1$ between the outer periphery of the impinging surface and the inner wall 214 of the pulverizing chamber was 25 mm.

The first classifier 109 had a structure as shown in an upper half of FIG. 33.

The crushed toner material was supplied at a rate of 28.0 kg/h via a table-type first metering feeder 102, an injection feeder 148 and a supply pipe 124 into the first classifier 109 (FIGS. 23 and 33). The classified coarse powder was supplied via a coarse powder exhaust hopper 332 to a pulverization feed supply pipe 205 (FIG. 33) and pulverized by a compressed air with a pressure of 6.0 kg/cm$^2$.G introduced at a rate of 6.0 Nm$^3$/min. The pulverized product was then mixed with the crushed toner material, and the mixture was recycled to the first gas stream classifier 109 so as to effect a closed circuit pulverization. The classified fine powder was withdrawn out of the classifier 109 while being accompanied with suction air by the operation of a suction fan to be collected by a cyclone 107 and supplied to a second metering feeder 110 (FIG. 23). The powder at this time showed a weight-average particle size of 7.4 μm and a sharp particle size distribution substantially free from particles of 12.7 μm or larger.

The fine powder was then supplied via the second metering feeder 110, a vibration feeder 103 and a feed supply pipe 116 (comprising a deformed tube section 133 or 33 and a supply nozzle 132 or 32) at a ratio of 34.0 kg/hr into a multi-division classifier 1 (FIG. 1) for classifying the powder feed into three fractions including a coarse powder fraction, a medium powder fraction and a fine powder fraction.

The introduction of the fine powder feed was performed by utilizing a suction force exerted by a reduced pressure in the classifier 1 caused by operation of the collecting cyclones 4, 5 and 6 connected to exhaust pipes 11, 12 and 13, respectively, and a compressed air injected into the feed supply pipe 116 by an injector 147 (FIG. 23).

The deformed tube section 33 of the feed supply pipe 116 (FIG. 1) had a shape shown in FIGS. 3 and 4 and having three mixing zones X, Y and Z. The angle $\theta$ with respect to the direction of introduction into the classifying zone was 30 degrees. By using a feed supply pipe of a transparent acrylic resin, the mixing of the upper stream A and the lower stream B was confirmed at the mixing zones X, Y and Z.

The fine powder feed was ejected into the classifying zone at a speed of about 90 m/sec.

The introduced powder feed was classified in an instant of at most 0.1 sec.

The classified coarse powder fraction was collected by a cyclone 106 and recycled to the pulverizer 108.

The classified medium powder fraction showed a weight-average particle size of 6.9 μm and a sharp distribution including 22% by number of particles with a particle size of at most 4.0 μm and 0.8% by volume of particles with a particle size of at least 10.08 μm, thus showing excellent properties as a toner powder.

The ratio of the finally obtained medium powder fraction to the total powder feed (i.e., classification efficiency) was 86%. The thus-obtained powder fraction was observed through an electron microscope, whereby substantially no agglomerates of 4 μm or larger formed by agglomeration of ultra-fine particles were observed.

EXAMPLE 8

The same crushed toner material as used in Example 7 was subjected to pulverization and classification in the same apparatus system shown in FIG. 23 in the same manner as in Example 7 except that the crushed toner material was supplied to the first classifier/pulverizer (109/108) at a rate of 22.0 kg/h to obtain fine powder having a weight-average particle size of 6.5 μm, and the fine powder was supplied to the multi-division classifier 1 at a rate of 25.0 kg/h to obtain a medium powder fraction having a weight-average particle size of 6.2 μm and having a sharp distribution (including 28% by number of particles with a particle size of at most 4.0 μm and 0.2% by volume of particles with a particle size of at least 10.08 μm) at a classification efficiency of 75%. The classified coarse powder was recycled to the pulverization step.

EXAMPLE 9

The same crushed toner material as used in Example 7 was subjected to pulverization and classification in a similar apparatus system shown in FIG. 23 as used in Example 7 except that the impinging gas stream classifier 108 was disposed to have an accelerating pipe inclination of 15 degrees, and the deformed tube section 133 (or 33) of the feed supply pipe 116 was one having a shape showing FIGS. 5 and 6 providing two mixing zones X and Y.

The crushed toner material was supplied to the first classifier/pulverizer (109/108) at a rate of 26.0 kg/h to obtain fine powder having a weight-average particle size of 7.3 μm, and the fine powder was supplied to the multi-division classifier at a rate of 32.0 kg/h to obtain a medium powder fraction having a weight-average particle size of 6.9 μm and having a sharp distribution (including 23% by number of particles with a particle size of at most 4.0 μm and 0.6% by volume of particles with a particle size of at least 10.08 μm) at a classification efficiency of 84%.

As a result of observation through the deformed tube section 133 (or 33) of a transparent acrylic resin, the mixing of the upper and lower streams A and B was confirmed at mixing zones X and Y.

EXAMPLE 10

The same crushed toner material as used in Example 7 was subjected to pulverization and classification in a similar apparatus system shown in FIG. 23 as used in Example 7 except that the deformed tube section 133 (or 33) of the feed supply pipe 116 was one having a shape showing FIGS. 7 and providing two mixing zones X and Y.

The crushed toner material was supplied to the first classifier/pulverizer (109/108) at a rate of 28.0 kg/h to obtain fine powder having a weight-average particle size of 7.3 μm, and the fine powder was supplied to the multi-division classifier at a rate of 34 kg/h to obtain a medium powder fraction having a weight-average particle size of 6.9 μm and having a sharp distribution (including 24% by number of particles with a particle size of at most 4.0 μm and 0.7% by volume of particles with a particle size of at least 10.08 μm) at a classification efficiency of 84%.

As a result of observation through the deformed tube section 133 (or 33) of a transparent acrylic resin, the mixing of the upper and lower streams A and B was confirmed at mixing zones X and Y.

EXAMPLE 11

The same crushed toner material as used in Example 7 was subjected to pulverization and classification in a similar apparatus system shown in FIG. 23 as used in Example 7 except the deformed tube section 133 (or 33) of the feed supply pipe 116 was one having a shape showing FIGS. 13 and 14 providing three mixing zones X, Y and Z by providing three baffle plates each having a height/tube height ($L_1/L_2$) ratio of ½.

The crushed toner material was supplied to the first classifier/pulverizer (109/108) at a rate of 28.0 kg/h to obtain fine powder having a weight-average particle size of 7.3 μm, and the fine powder was supplied to the multi-division classifier at a rate of 34.0 kg/h to obtain a medium powder fraction having a weight-average particle size of 6.9 μm and having a sharp distribution (including 21% by number of particles with a particle size of at most 4.0 μm and 0.8% by volume of particles with a particle size of at least 10.08 μm) at a classification efficiency of 86%.

As a result of observation through the deformed tube section 133 (or 33) of a transparent acrylic resin, the mixing of the upper and lower streams A and B was confirmed at mixing zones X, Y and Z.

EXAMPLES 12

| | |
|---|---|
| Unsaturated polyester resin | 100 wt. parts |
| Copper phthalaocyanine pigment (C.I. Pigment Blue 15) | 4.5 wt. parts |
| Charge control agent (salicyclic acid chromium complex) | 4.0 wt. parts |

The above ingredients were blended well in a Henschel mixer ("FM-75", mfd. by Mitsui Miike Kakoki K.K.) and then kneaded by a twin-screw extruder ("PCM-30", mfd. by Ikegai Tekko K.K.) set at 100° C. The thus-kneaded product, after being cooled, was coarsely crushed by a hammer mill to 1 mm or smaller to form a crushed toner material.

The crushed toner material was introduced into an apparatus system shown in FIG. 23 for pulverization and classification.

The first classifier/pulverizer (109/108) were identical to those used in Example 7 and operated under similar conditions as in Example 7.

The crushed toner material was supplied at a rate of 25.0 kg/h via a table-type first metering feeder 102, an injection feeder 148 and a supply pipe 124 into the first classifier 109 (FIGS. 23 and 33). The classified coarse powder was supplied via a coarse powder exhaust hopper 332 to a pulverization feed supply pipe 205 (FIG. 33) and pulverized by a compressed air with a pressure of 6.0 kg/cm$^2$.G introduced at a rate of 6.0 Nm$^3$/min. The pulverized product was then mixed with the crushed toner material, and the mixture was recycled to the first gas stream classifier 109 so as to effect a closed circuit pulverization. The classified fine powder was withdrawn out of the classifier 109 while being accompanied with suction air by the operation of a suction fan to be collected by a cyclone 107 and supplied to a second metering feeder 110 (FIG. 23). The powder at this time showed a weight-average particle size of 7.4 μm.

The fine powder was then supplied via the second metering feeder 110, a vibration feeder 103 and a feed supply pipe 116 (comprising a deformed tube section 133 or 33 and a supply nozzle 132 or 32) at a rate of 30.0 kg/hr into a multi-division classifier 1 (FIG. 1) for classifying the powder feed into three fractions including a coarse powder fraction, a medium powder fraction and a fine powder fraction.

The introduction of the fine powder feed was performed by utilizing a suction force exerted by a reduced pressure in the classifier 1 caused by Operation of the collecting cyclones 4, 5 and 6 connected to exhaust pipes 11, 12 and 13, respectively, and a compressed air injected into the feed supply pipe 116 by an injector 147 (FIG. 23).

The deformed tube section 33 of the feed supply pipe 116 (FIG. 1) had a shape shown in FIGS. 3 and 4 and having three mixing zones X, Y and Z. The angle $\theta$ with respect to the direction of introduction into the classifying zone was 30 degrees. By using a feed supply pipe of a transparent acrylic resin, the mixing of the upper stream A and the lower stream B was confirmed at the mixing zones X, Y and Z.

The fine powder feed was ejected into the classifying zone at a speed of about 90 m/sec.

The introduced powder feed was classified in an instant of at most 0.1 sec.

The classified coarse powder fraction was collected by a cyclone 106 and recycled to the pulverizer 108.

The classified medium powder fraction showed a weight-average particle size of 6.6 μm and a sharp distribution including 23% by number of particles with a particle size of at most 4.0 μm and 0.8% by volume of particles with a particle size of at least 10.08 μm, thus showing excellent properties as a toner powder.

The ratio of the finally obtained medium powder fraction to the total powder feed (i.e., classification efficiency) was 82%.

COMPARATIVE EXAMPLE 4

A crushed toner material was prepared in the same manner as in Example 7.

The crushed toner material was subjected to pulverization and classification in an apparatus system generally shown in FIG. 23 but including an impinging gas stream classifier 108 having a structure as shown in FIG. 38 and a multi-division classifier (second classifier) 1 having a structure as shown in FIGS. 17 and 20 including a feed supply pipe 16 having a straight tube section otherwise in a similar manner as in Example 7.

The first classifier 109 had a structure as shown in an upper half of FIG. 33.

The crushed toner material was supplied at a rate of 13.0 kg/h via a table-type first metering feeder 102, an injection feeder 148 and a supply pipe 124 into the first classifier 109 (FIGS. 23 and 33). The classified coarse powder was supplied via a coarse powder exhaust hopper 332 to a pulverization feed supply hopper 440 of an impinging gas stream pulverizer having a structure shown in FIG. 38 and pulverized by a compressed air with a pressure of 6.0 kg/cm$^2$.G introduced at a rate of 6.0 Nm$^3$/min. The pulverized product was then mixed with the crushed toner material, and the mixture was recycled to the first gas stream classifier 109 so as to effect a closed circuit pulverization. The classified fine powder was withdrawn out of the classifier 109 while being accompanied with suction air by the operation of a suction fan to be collected by a cyclone 10.7 (FIG. 23) and supplied to a second metering feeder 2 (FIG. 20). The powder at this time showed a weight-average particle size of 7.1 μm.

The fine powder was then supplied via the second metering feeder 110, a vibration feeder 103 and a feed supply pipe 16 (comprising a straight tube section 16a and a supply nozzle 16b) at a rate of 15.0 kg/hr into a multi-division classifier 101 (FIG. 17) for classifying the powder feed into three fractions including a coarse powder fraction, a medium powder fraction and a fine powder fraction.

The introduction of the fine powder feed was performed by utilizing a suction force exerted by a reduced pressure in the classifier 101 caused by operation of the collecting cyclones 4, 5 and 6 connected to exhaust pipes 11, 12 and 13, respectively, and a compressed air injected into the feed supply pipe 16 (FIG. 20).

The straight tube section 16a of the feed supply pipe 16 had a shape shown in FIGS. 18 and 19. By using a feed supply pipe of a transparent acrylic resin, it was confirmed that the upper stream A and the lower stream B were not mixed with each other but flowed in separate streams.

As a result, there was obtained a medium powder fraction having a weight-average particle size of 6.9 μm and having a particle size distribution (including 27% by number of particles with a particle size of at most 4.0 μm and 1.5% by volume of particles with a particle size of at least 10.08 μm) at a classification efficiency of 81%.

Compared with Example 7, the medium powder fraction showed a broader particle size distribution, yet was obtained at a somewhat lower classification efficiency.

COMPARATIVE EXAMPLE 5

A crushed toner material was prepared in the same manner as in Example 12.

The crushed toner material was subjected to pulverization and classification in an apparatus system generally shown in FIG. 23 but including an impinging gas stream classifier 108 having a structure as shown in FIG. 38 and a multi-division classifier (second classifier) 1 having a structure as shown in FIGS. 17 and 20 including a feed supply pipe 16 having a straight tube section otherwise in a similar manner as in Example 12.

The first classifier 109 had a structure as shown in an upper half of FIG. 33.

The crushed toner material was supplied at a rate of 12.0 kg/h via a table-type first metering feeder 102, an injection feeder 148 and a supply pipe 124 into the first classifier 109 (FIGS. 23 and 33). The classified coarse powder was supplied via a coarse powder exhaust hopper 332 to a pulverization feed supply hopper 440 of an impinging gas stream pulverizer having a structure shown in FIG. 38 and pulverized by a compressed air with a pressure of 6.0 kg/cm$^2$.G introduced at a rate of 6.0 Nm$^3$/min. The pulverized product was then mixed with the crushed toner material, and the mixture was recycled to the first gas stream classifier 109 so as to effect a closed circuit pulverization. The classified fine powder was withdrawn out of the classifier 109 while being accompanied with suction air by the operation of a suction fan to be collected by a cyclone 107 (FIG. 23) and supplied to a second metering feeder 2 (FIG. 20). The powder at this time showed a weight-average particle size of 7.0 μm.

The fine powder was then supplied via the second metering feeder 110, a vibration feeder 103 and a feed supply pipe 16 (comprising a straight tube section 16a and a supply nozzle 16b) at a rate of 14.0 kg/hr into a multi-division classifier 101 (FIG. 17) for classifying the powder feed into three fractions including a coarse powder fraction, a medium powder fraction and a fine powder fraction.

The introduction of the fine powder feed was performed by utilizing a suction force exerted by a reduced pressure in the classifier 101 caused by operation of the collecting cyclones 4, 5 and 6 connected to exhaust pipes 11, 12 and 13, respectively, and a compressed air injected into the feed supply pipe 16 (FIG. 20).

The straight tube section 16a of the feed supply pipe 16 had a shape shown in FIGS. 18 and 19. By using a feed supply pipe of a transparent acrylic resin, it was confirmed that the upper stream A and the lower stream B were not mixed with each other but flowed in separate streams.

As a result, there was obtained a medium powder fraction having a weight-average particle size of 6.5 μm and having a particle size distribution including 28% by number of particles with a particle size of at most 4.0 μm and 1.6% by volume of particles with a particle size of at least 10.08 μm) at a classification efficiency of 76%.

Compared with Example 12, the medium powder fraction showed a broader particle size distribution, yet was obtained at a somewhat lower classification efficiency.

According to the toner production system of the present invention, it is possible to obtain a toner having a sharp particle size distribution at a high pulverization efficiency and a high classification efficiency. It is also possible to prevent the occurrence of melt-sticking, agglomeration or coarsening of toner particles and prevent the abrasion of the apparatus with toner components, thereby allowing a continuous and stable production. By using the toner production system according to the present invention, it is possible to produce a toner for developing electrostatic images having a prescribed particle size distribution and providing excellent images which have a stably high image density and excellent image quality even after continuous image formation and are free from image defects such as fog and those attributable to cleaning failure. Moreover, it is possible to produce a toner containing at least 50% by number of particles having a particle size of at most 20 μm at a good efficiency.

Particularly, it is possible to produce a toner having a sharp particle size distribution from a toner powder feed having a weight-average particle size of at most 10 μm, especially at most 8 μm, at a good efficiency.

What is claimed is:

1. A process for producing a toner, comprising:

introducing a feed powder containing a binder resin and a colorant together with a gas into a feed supply pipe to form an upper stream and a lower stream of the feed powder and an accompanying gas stream, respectively flowing through the feed supply pipe, causing the upper stream and the lower stream to change their flowing directions to mix the upper and lower streams, ejecting the feed powder into a classifying zone together with and under the action of the accompanying gas stream, classifying the feed powder into at least a coarse powder fraction at a first fractionating zone, a medium powder fraction at a second fractionating zone and a fine powder fraction at a third fractionating zone, and a stream of the feed powder and an accompanying gas stream, respectively flowing through within the feed supply pipe, and recovering the medium powder fraction as a toner for developing electrostatic images.

2. The process according to claim 1, wherein the gas stream ejected into the classifying zone is caused to change its flowing direction by the Coanda effect exerted by a Coanda block.

3. The process according to claim 1, wherein the upper and lower streams are caused to change their flowing directions plural times within the feed supply pipe.

4. The process according to claim 3, wherein the upper and lower streams are caused to change their flowing directions 2–5 times within the feed supply pipe.

5. The process according to claim 1, wherein said feed supply pipe comprises a supply nozzle section and a tube section, and the upper and lower streams are caused to change their flowing directions plural times within the tube section.

6. The process according to claim 5, wherein the upper and lower streams are caused to change their flowing directions 2–5 times within the tube section.

7. The process according to claim 1, wherein said feed powder has a weight-average particle size of at most 10 μm.

8. The process according to claim 7, wherein said feed powder has a weight-average particle size of at most 8 μm.

9. The process according to claim 1, wherein the coarse powder fraction is classified as an outer stream, the medium powder fraction is classified as a medium stream and the fine powder fraction is classified as an inner stream, respectively with respect to an opening of the feed supply pipe in the classifying zone.

10. The process according to claim 1, wherein the colorant is a material selected from the group consisting of a dye, a pigment and a magnetic material.

11. A process for producing a toner, comprising:

melt-kneading a blend comprising at least a binder resin and a colorant to form a kneaded product, cooling the kneaded product, crushing the cooled kneaded product to form a crushed product, classifying the crushed product into a coarse powder and a first fine powder by a first classifying means, pulverizing the coarse powder by an impinging gas stream pulverizing means to form a pulverized coarse powder, recycling the pulverized coarse powder to the first classifying means and introducing the first fine powder from the first classifying means to a second classifying means, and classifying the first fine powder to recover a medium powder fraction constituting a toner for developing electrostatic images, wherein said impinging gas stream pulverizing means comprises an accelerating pipe for conveying and accelerating the coarse powder supplied thereto together with a compressed gas stream, a pulverizing chamber for pulverizing the coarse powder, a coarse powder inlet for supplying the coarse powder into the accelerating pipe disposed close to a rear end of the accelerating pipe, and an impinging member having an impinging surface confronting an outlet opening of the accelerating pipe and disposed within the pulverizing chamber; said pulverizing chamber having a side wall and an entrance wall defining the outlet opening of the accelerating pipe, the side wall having a function of further pulverizing a pulverized product of the coarse powder pulverized by impingement onto the impinging member, said impinging member being disposed within a pulverizing chamber so that a peripheral edge of the impinging is spaced width a minimum distance $L_1$ from the side wall of the pulverizing chamber and with a minimum distance $L_2$ from the entrance wall of the pulverizing chamber satisfying $L_1 < L_2$;

said second classifying means comprises a classifying chamber and a feed supply pipe leading to and opening into the classifying chamber;

the first fine powder from the first classifier is introduced as a feed powder together with a gas into the feed supply pipe to form an upper stream and a lower stream of the feed powder and an accompanying gas stream, respectively flowing through the feed supply pipe;

the upper stream and the lower stream are caused to change their flowing directions to be mixed with each other, the feed powder is ejected at a speed of 50–300 m/sec into the classifying chamber together with and under the action of the accompanying gas stream;

the feed powder is classified into at least a coarse powder fraction at a first fractionating zone, a medium powder fraction at a second fractionating zone and a fine powder fraction at a third fractionating zone under the action of an inertia force acting on particles of the feed powder ejected and a centrifugal force of a curved gas stream due to Coanda effect;

the coarse powder fraction principally comprising particles having a particle size exceeding a prescribed range is recovered in a first fractionating zone, the medium powder fraction principally comprising particles having a particle size within the prescribed range, and the fine powder fraction principally comprising particles having a particle size below the prescribed range; and the recovered coarse powder fraction is recycled to the impinging gas stream pulverizing means or the first classifying means.

12. The process according to claim 11, wherein said feed powder has a weight-average particle size of at most 10 μm.

13. The process according to claim 12, wherein said feed powder has a weight-average particle size of at most 8 μm.

14. The process according to claim 11, wherein the gas stream ejected into the classifying zone is caused to change its flowing direction by the Coanda effect exerted by a Coanda block.

15. The process according to claim 11, wherein the upper and lower streams are caused to change their flowing directions plural times within the feed supply pipe.

16. The process according to claim 15, wherein the upper and lower streams are caused to change their flowing directions 2–5 times within the feed supply pipe.

17. The process according to claim 11, wherein said feed supply pipe comprises a supply nozzle section and a tube section, and the upper and lower streams are caused to change their flowing directions plural times within the tube section.

18. The process according to claim 17, wherein the upper and lower streams are caused to change 2–5 times their flowing directions within the tube section.

19. The process according to claim 11, wherein the first fractionating zone is disposed as an outer zone, the second fractionating zone is disposed as a medium zone and the third fractionating zone is disposed as an inner zone, respectively with respect to the opening of the feed supply pipe in the classifying chamber.

20. The process according to claim 11, wherein said accelerating pipe is disposed to have a longitudinal axis forming an angle of inclination from a vertical line of 0–45 degrees.

21. The process according to claim 20, wherein said accelerating pipe is disposed to have a longitudinal axis forming an angle of inclination from a vertical line of 0–20 degrees.

22. The process according to claim 21, wherein said accelerating pipe is disposed to have a longitudinal axis forming an angle of inclination from a vertical line of 0–5 degrees.

* * * * *

UNITED STATES PATENT AND TRADEMARK OFFICE

CERTIFICATE OF CORRECTION

PATENT NO. : 5,447,275

DATED : September 5, 1995

INVENTOR : YOKO GOKA ET AL.

It is certified that errors appear in the above-identified patent and that said Letters Patent is hereby corrected as shown below:

ON THE TITLE PAGE:

AT [56] REFERENCES CITED

Other Publications,

"Hemispher" should read --Hemisphere--.

AT SHEET 14

Figure 22, "CLASS-" should read --CLASSI- --.

AT SHEET 15

Figure 23, "CLASS-" should read --CLASSI- --

COLUMN 1

Line 36, "as-shown" should read --as shown--.

COLUMN 3

Line 5, "blow" should read --below--;

Line 9, "blow" should read --particles below--;

Line 16, "let" should read --jet--;

Line 19, "a" should read --an--;

Line 31, "and-ejected" should read --and ejected--.

COLUMN 7

Line 22, "are" should read --and--.

UNITED STATES PATENT AND TRADEMARK OFFICE

CERTIFICATE OF CORRECTION

PATENT NO. : 5,447,275

DATED : September 5, 1995

INVENTOR : YOKO GOKA ET AL.

It is certified that errors appear in the above-identified patent and that said Letters Patent is hereby corrected as shown below:

COLUMN 10

Line 44, "ally, V-shaped" should read --ally V-shape--.

COLUMN 12

Line 17, "5-300m/sec." should read --50-300m/sec.--.

COLUMN 21

Line 64, "(Day." should read --(Dav.--.

COLUMN 22

Line 56, "1%-NaCl" should read --1% NaCl--.

COLUMN 23

Line 54, "8) should read --8--.

COLUMN 25

Line 58, "including" should read --(including--.

COLUMN 26

Line 33, "EXAMPLES 7" should read --EXAMPLE 7--.

COLUMN 29

Line 26, "EXAMPLES 12" should read --EXAMPLE 12--.

UNITED STATES PATENT AND TRADEMARK OFFICE

CERTIFICATE OF CORRECTION

PATENT NO. : 5,447,275

DATED : September 5, 1995

INVENTOR(S) : YOKO GOKA ET AL.

It is certified that error appears in the above-identified patent and that said Letters Patent is hereby corrected as shown below:

COLUMN 30

Line 7, "Operation" should read --operation--;

Line 65, "cyclone 10.7" should read --cyclone 107--.

COLUMN 32

Line 18, "including" should read --(including--;

Line 68, "a stream of the feed powder and an" should be deleted.

COLUMN 33

Lines 1 and 2 should be deleted.

COLUMN 34

Line 6, "impinging" should read --impinging member--; and "width" should read --with--;

Line 22, "other," should read --other;--.

Signed and Sealed this

Second Day of April, 1996

Bruce Lehman

*Attest:*

BRUCE LEHMAN

*Attesting Officer*

*Commissioner of Patents and Trademarks*